United States Patent [19]

Hubert et al.

[11] 4,170,414

[45] Oct. 9, 1979

[54] DOCUMENT FEED CONTROLS FOR COPY PRODUCTION MACHINES

[75] Inventors: Wallace L. Hubert, Broomfield; Thomas T. Underhill, Boulder, both of Colo.

[73] Assignee: International Business Machines Corporation, Armonk, N.Y.

[21] Appl. No.: 752,775

[22] Filed: Dec. 20, 1976

[51] Int. Cl.[2] ..... G03G 15/00; B65H 7/02

[52] U.S. Cl. ..... 355/14; 198/467; 198/468; 271/259; 340/675; 355/3 SH

[58] Field of Search ..... 355/3 R, 3 SH, 14; 271/258, 259; 340/675; 198/465, 467, 468

[56] References Cited

U.S. PATENT DOCUMENTS

| | | | |
|---|---|---|---|
| 3,473,035 | 10/1969 | Gardner et al. | 355/3 R X |
| 3,626,956 | 12/1971 | Sauder | 271/259 X |
| 3,936,041 | 2/1976 | Shiina et al. | 271/258 X |

OTHER PUBLICATIONS

Hubbard et al, "Copier Controls", IBM Technical Disclosure Bulletin, Oct. 1976, vol. 19, No. 5, pp. 1589–1591.

*Primary Examiner*—Fred L. Braun
*Attorney, Agent, or Firm*—H. F. Somermeyer; C. M. Wright

[57] ABSTRACT

Copy production machine, such as a xerographic copier, includes an original document feed mechanism which is responsive to insertion of the document to place the document automatically in an imaging position. The copy production machine is actuated by the document feed mechanism to produce one or more copies of the placed original document. An original document being entered into imaging position may be removed by an operator or by the automatic original document feed mechanism, whereby the copy production machine is inhibited from producing copies until the original document is either reinserted or another original document is inserted. Thereupon, copy production resumes in the normal manner.

9 Claims, 11 Drawing Figures

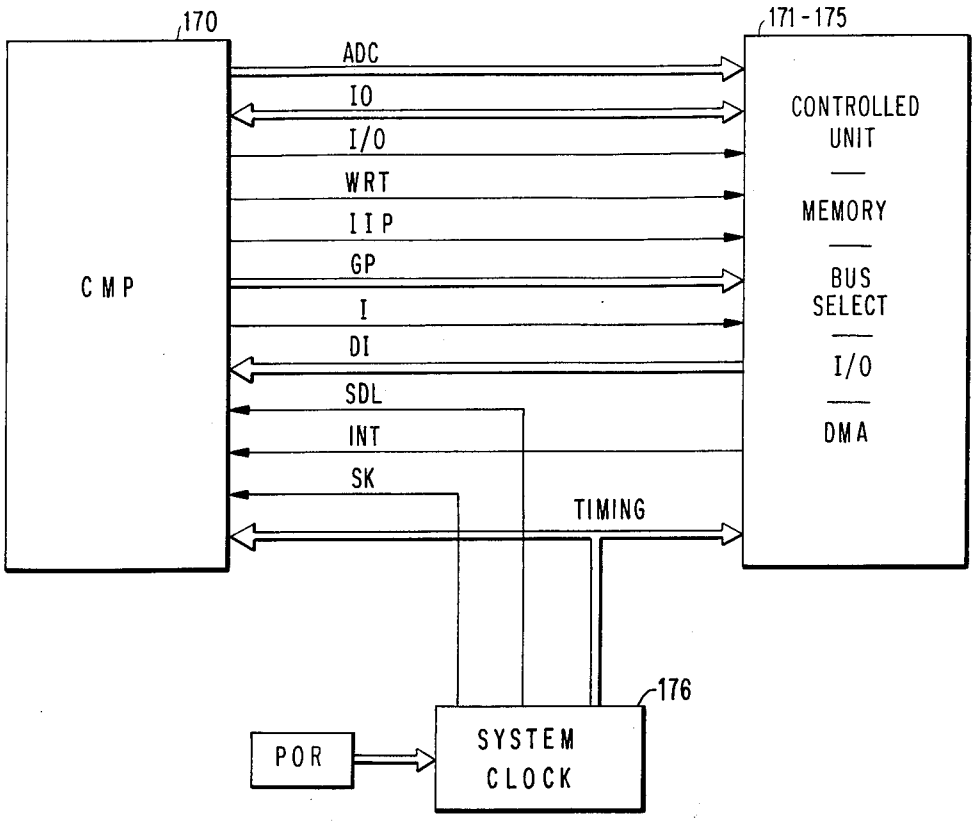
FIG. 5
FIG. 4
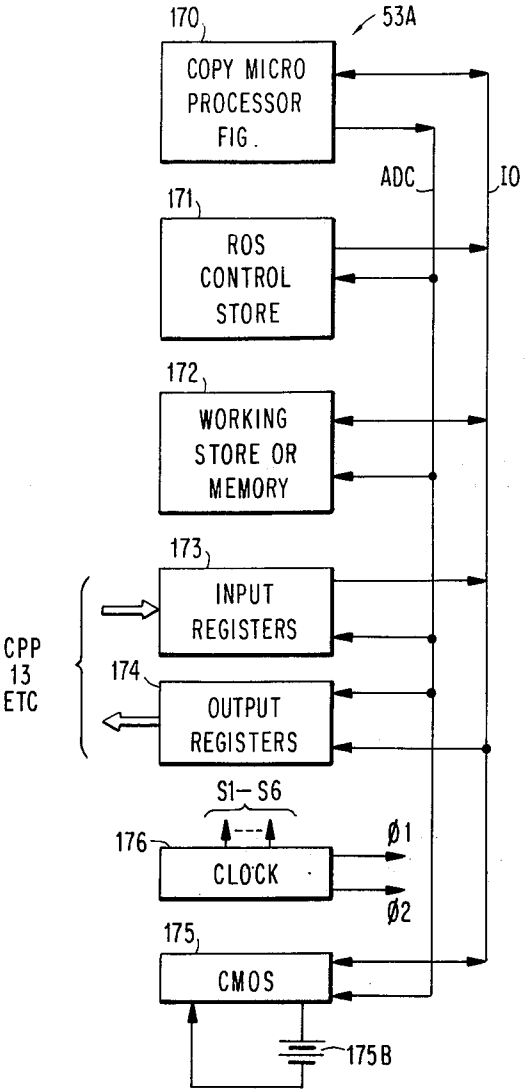

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| AR SR LR | IBL | M | (TB⇒IB) IRH | M X | PCI | -M NOTE 4 | (TERM) | NOTE 4 | | | | |
| LRE LRD | IBL | M | (TB⇒IB) IRH | M X | PCI | -M NOTE 5 | WRT IRL | NOTE 5 | WRT IRH | TBNS (XX→DB) ACH + DO | (TERM) | TBNS |
| STR | PCI | M | (TB⇒IB) WRT IRH | X (X→DB) ACH→DO | WRT IRL | ACL→DO | (TERM) | TBNS | | | | |
| AI SI | PCI | M | PCI | M NOTE 1 | (TERM) | NOTE 5 | | | | | | |
| CI GPI [LI XI OI NI] | PCI | M | PCI | M ACL x TB → DO → [ACL] | (TERM) | X | | | | | | |
| CB [AB SB LB XB OB NB] | PCI | M | TB | M (ACL→DO) | (TB⇒IB) PCI | X | (TERM) | ACL ± TB → DO → [ACL] | | | | |
| STB | PCI | M | WRT TB | ACL→DO | (TB⇒IB) PCI | X | (TERM) | X | | | | |
| A1 S1 SHL SHR | PCNI | M | (TB⇒IB) PCI | -M NOTE 2 | (TERM) | NOTE 2 | | | | | | |
| TRA | PCI | M | (TERM) | NOTE 3 | | | | | | | | |
| CLA / [IC] | PCI | M CL AC / SET IC | (TERM) | X / COT ± → EQ | | | | | | | | |
| TBP [TBR] | PCI | M | (TERM) | ACL M → DO → [ALL] | | | | | | | | |
| POR (IJD) | | | | | | | IB→"CLA" POR CODE | X RST LOGIC 32→DO | | | | |

INSTRUCTION ↑ PREVIOUS ↓

TIME Ø2 220 Ø1 Ø2 Ø1 Ø2 Ø1 Ø2 Ø1 Ø2 Ø1 Ø2 Ø1 Ø2

NOTE 1: ACL±TB ; +DB→ACH ; ACH→DO→ACL
NOTE 2: ACL MODIF→DB→ACH ; ACH→DO→ACL
NOTE 3: ACL→DB→ACH ; ACH→DO→ACL
NOTE 4: ACL ± TB→DB→ACH ; ACH→DO→ACL
NOTE 5: ACL +Δ→BB→ACH ; ACH→DO→ACL

FIG. 7

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| BAL | PCI | PREVIOUS INSTRUCTION | IB SET PCI | (ACH→DO) ACL→DB | NOTE 7 | PCL→DO | WRT IRH | PCH-1 + CR →DO | NOTE 9 | NOTE 10 | (TERM) | SET TRA |
| RTN | IBL | | IRH | NOTE 5 | IRL+8 | (ACH→DO) ACL→DB | NOTE 8 | NOTE 10 | PCI | NOTE 11 | (TERM) | (ACL→DO) |
| BØØ | PCNI | | NOTE 3 | PCH-1 → AOH | PCI | X | (TERM) | X | | | | |
| $\overline{\text{BØØ}}$ | PCI | | PCI | X | (TERM) | X | | | | | | |
| IJO | PCNI | | NOTE 4 | PCH-1 → ACH | PCI | X | (TERM) | X | | | | |
| $\overline{\text{IJO}}$ | PCI | | (TERM) | X | | | | | | | | |
| BLI | IBL | | (TB⟹IB) IRH | NOTE 5 | PCI | (ACH→DO) ACL→DB | ACL→AOH TB→AOL | NOTE 10 | (TERM) | ITAL | | |
| BSI | IBL | | (TB⟹IB) IRH | NOTE 5 | PCI | (ACH→DO) ACL→DB | WRT ACL→AOH TB→AOL | NOTE 10 | (TERM) | TBNS | | |
| IN | PCI | | OUT 1st IO WRT TB | NOTE 6 | OUT 2nd IO WRT TB | ACL→DO | (TB⟹IB) PCI | X | (TERM) | IOD AC7*→EQ | | |
| OUT | PCI | | OUT 1st IO WRT TB | NOTE 6 | OUT 2nd IO WRT TB | ACL→DO | (TB⟹IB) PCI | X | (TERM) | IOD AC7*→EQ | | |
| INTERUPT 1-5 | NOTE 1 | | STR ACH WRT 4H | NOTE 5 | STR LOW AC WRT 4L | ACL→DB ACH→DO | STR OLD STAT WRT 8L | TBNS STAT →DO→ACL | HI ADD READ 12 H | TBNS PCL→DO →ACL | (TERM) | |
| INTERUPT 6-10 | NOTE 2 | ACL-1→DO | STR PCH WRT OH | PCH-1 + CR →DO | NEW STAT 8H | X | NOTE 9 | NOTE 10 | PCI | UPDATE STAT | (TERM) | |
| | 220 Ø1 | | Ø2 Ø1 | | Ø2 Ø1 | | Ø2 Ø1 | | Ø2 Ø1 | | Ø2 Ø1 | Ø2 |

NOTE 1: LOW ADDRESS READ 12L
NOTE 2: STR PCL WRT OL
NOTE 3: CAL HIGH BITS; TB→AOL
NOTE 4: CAL HIGH BITS; IB→AOL
NOTE 5: ACL→DB→ACH; ACH→DO→ACL
NOTE 6: TB (MODIFIED)→DO
NOTE 7: SET IB TO "TRAP"; WRITE IRL
NOTE 8: UPDATE PC; ACL→ACH; TB→ACL
NOTE 9: UPDATE PC; ACL→AOH; TB→AOL
NOTE 10: ACL→AOH; DB→ACH; ACH→DO→ACL
NOTE 11: (ACL→DO) STAT UPDATE IF REGO GRPO

FIG. 8

| | GROUP | MEMORY TYPE |
|---|---|---|
| ZONE 3 | 31 | DIAGNOSTIC SPACE |
| | 30 | REPLICATE I/O |
| | 29 | CMOS |
| | 28 | |
| | 27 | WORK REGISTERS |
| | 26 | |
| | 25 | |
| | 24 | |
| ZONE 2 | 23 | DIAGNOSTIC SPACE |
| | 22 | REPLICATE I/O |
| | 21 | CMOS |
| | 20 | |
| | 19 | WORK REGISTERS |
| | 18 | |
| | 17 | |
| | 16 | |
| ZONE 1 | 15 | DIAGNOSTIC SPACE |
| | 14 | REPLICATE I/O |
| | 13 | CMOS |
| | 12 | |
| | 11 | WORK REGISTERS |
| | 10 | |
| | 9 | |
| | 8 | |
| ZONE 0 | 7 | DIAGNOSTIC SPACE |
| | 6 | REPLICATE I/O |
| | 5 | CMOS |
| | 4 | |
| | 3 | WORK REGISTERS |
| | 2 | |
| | 1 | |
| | 0 | |

DOCUMENT FEED CONTROLS FOR COPY PRODUCTION MACHINES

BACKGROUND OF THE INVENTION

The present invention relates to copy production machines, particularly to those machines having input original document-responsive document feeding apparatus.

Convenience copiers, high speed duplicators, and other forms of copy production machines have been receiving increasingly wide usage. The primary advantage in such machines for providing throughput is the input document, responsive document feed, commonly referred to as a semiautomatic document feed (SADF). Such an input mechanism tends to maximize the throughput of copy production machines, particularly convenience copiers. In higher speed copy production machines, automatic document feeds (ADFS) act as original document suppliers.

Generally, such input document, responsive feed mechanisms sense the input document and then actuate rollers or other picking mechanisms for moving the document into an imaging position, usually on a so-called document glass. On occasion, an operator may inadvertently insert the wrong original document. In such an instance the wrong operator can remove the document from the document feed path which results in a blank copy being produced, requiring further operator action in removing the blank copy from a stack of produced copies. Similarly, machine conditions can arise wherein the document being inserted is desired not to be copied but that a different original document should be copied next. In such a situation, automatic apparatus can also retrieve an inadvertently inserted document from a document feed. Such an instance could occur during a jam recovery and the like.

SUMMARY OF THE INVENTION

It is an object of the invention to provide enhanced document feed control for eliminating inadvertent blank copy production.

In accordance with the invention, a copy production machine has an input document responsive document feed. Such document feed includes a preentry sensor and an entry sensor. Generally, the document feed is actuated when the preentry sensor senses an original document to be entered and the copy production machine is ready to produce copies. The document feed actuates rollers and so forth for moving the document from the preentry position past an entry sensor onto a document glass or other imaging position. In normal operation the sequence of operations is that the preentry sensor first senses the document and the document is last sensed by the entry sensor. However, if the document is removed, the entry sensor no longer senses the document last; instead, the preentry sensor senses the document last. This sequence of events is interpreted by the copier control to inhibit production of copies since no document will be in an imaging position.

The foregoing and other objects, features, and advantages of the invention will be apparent from the following more particular description of preferred embodiments of the invention illustrated in the accompanying drawings.

BRIEF DESCRIPTION OF THE DRAWINGS

FIG. 4 is a block diagram of a programmable control used to control the FIG. 1 illustrated machine.

FIG. 5 is a simplified diagram showing interconnection protocol for the FIG. 4 illustrated system.

FIGS. 7 and 8 are charts showing the instruction repertoire of a microprocessor shown in FIG. 6.

DETAILED DESCRIPTION

Figure 1:
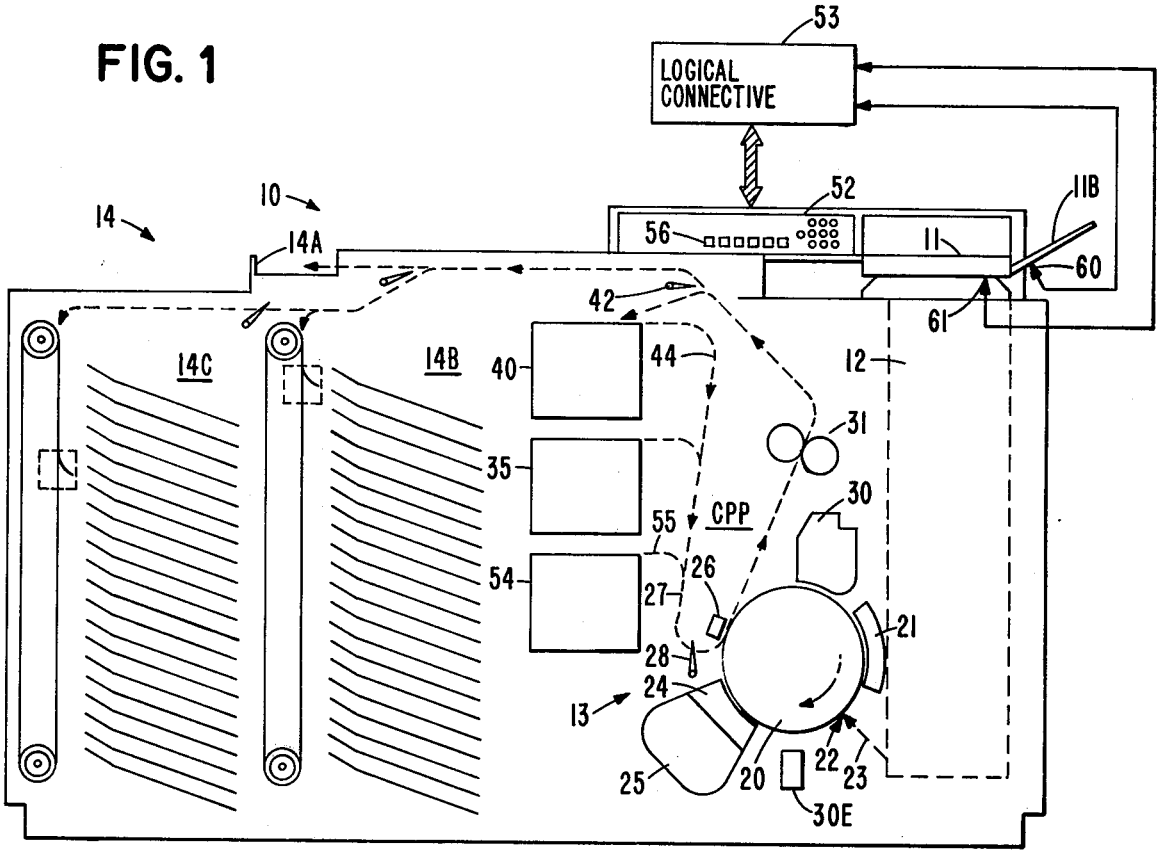
FIG. 1 is a diagrammatic showing of a copy production machine employing the teachings of the present invention.

In the drawings, like numerals indicate like parts and structural features in the various figures. A copy production machine 10 (FIG. 1) employing a constructed version of the present invention includes a semiautomatic document feed (SADF) 11 for feeding manually inserted original documents to be copied. The document glass 11A (FIG. 2) in SADF 11 is scanned by known optical scanners in original input optics 12 (FIG. 1) to provide an illuminated image over path 23 to a later described copy production portion (CPP) 13. Copy production portion 13 transfers the line 23 indicated optical image to copy paper as will be later described and supplies the produced copies to output portion 14 for pick up by an operator or for automatic transfer to other utilization apparatus (not shown). In a constructed version of the invention, output portion 14 includes a copy output tray 14A which receives all produced copies in a so-called noncollate mode. When the copy production machine 10 is to be used in an environment requiring automatic collation, a collator 14B is included in output portion 14. When the number of copies to be collated becomes relatively large, a second collator 14C is connected to the first collator 14B in tandem for receiving copies to be collated.

In accordance with the present invention, control means are provided in the copy production machine for automatically controlling CPP 13 when an original document being entered onto document glass (FIG. 2) is removed by an operator or by an automatic document supplier (not shown). Such action consists of moving the original document from SADF 11 toward input tray 11B. This motion is sensed and analyzed by programmed logical connective 53 for SADF 11 control as will become apparent.

The copy production machine 10 includes an operator's control panel 52 having a plurality of manually actuable switches for introducing copy production parameters to copy production portion 13. Such parameters are well known and are not detailed except for those parameters arbitrarily having an operative and direct relationship with a first constructed embodiment of the present invention. Panel 52 operator-entered parameters are interpreted by connective 53; then corresponding control signals are supplied to CPP 13, optics 12, output 14 for operating them in a known manner. The present invention adds additional controls and functions to the known operations as will be detailed.

Before proceeding further with the description of the invention, the operation of copy production portion (CPP) 13 is described as a constructed embodiment of a so-called xerographic copy production machine 10, no limitation thereto intended. Photoconductor drum member 20 rotates in the direction of the arrow past a plurality of xerographic processing stations. The first station 21 imposes either a positive or negative electrostatic charge on the surface of photoconductor member 20. It is preferred that this charge be a uniform electrostatic charge over a uniform photoconductor surface. Such charging is done in the absence of light such that projected optical images, indicated by dash line arrow 23, alter the electrostatic charge on the photoconductor member in preparation for image developing and transferring. The projected optical image from original input optics 12 exposes the photoconductor surface in area 22. Light in the projected image electrically discharges the surface areas of photoconductor member 20 in proportion to light intensity. With minimal light reflected from the dark or printed areas of an original document, for example, there is no corresponding discharge and the electrostatic charge remains in those areas of the photoconductive surface of member 20 corresponding to the dark or printed areas of an original document in SADF 11 (semiautomatic document feed). This charge pattern is termed a "latent" image on the photoconductor surface. Interimage erase lamp 30E discharges photoconductor member 20 outside defined image areas.

The next xerographic station is developer 24 which receives toner (ink) from toner supply 25 for being deposited and retained on the photoconductive surface still having an electrical charge. The developer station receives the toner with an electrostatic charge of opposite polarity to that of the charged areas of the photoconductive surface. Accordingly, the toner particles adhere electrostatically to the charged areas but do not adhere to the discharged areas. Hence, the photoconductive surface, after leaving station 24, has a toned image corresponding to the dark and light areas of an original document in SADF 11.

Next, the latent image is transferred to copy paper (not shown) in transfer station 26. The paper is brought to the station 26 from an input paper path portion 27 via synchronizing input gate 28. In station 26, the copy paper (not shown) is brought into contact with the toned image on the photoconductive surface resulting in a transfer of the toner to the copy paper. After such transfer, the sheet of image bearing copy paper is stripped from the photoconductive surface and the image is fused thereon in fusing station 31 for creating a permanent image on the copy paper.

On the photoconductor member 20, after the image area on member 20 leaves transfer station 26, there is a certain amount of residual toner on the photoconductive surface. Accordingly, cleaner station 30 has a rotating cleaning brush (not shown) to remove the residual toner for cleaning the image area in preparation for receiving the next image projected by original input optics 12. The cycle then repeats by charging the just-cleaned image area at charging station 21.

The production of simplex copies or the first side of duplex copies by portion 13 includes transferring a blank sheet of paper from blank paper supply 35, thence to transfer station 26, fuser 31, and, when in the simplex mode, directly to the output copy portion 14. Blank paper supply 35 has an empty sensing switch (not shown) which inhibits operation of CPP 13 in a known manner whenever supply 35 is out of paper.

When in the duplex mode, duplex diversion gate 42 is actuated by connective 53 to the upward position for deflecting single-image copies to travel to interim storage unit 40 to reside as partially produced duplex copies (image on one side only) waiting for the next single-image copy producing run in which the copies receive the second image. In the next single-image run in the duplex mode, initiated by inserting a document into SADF 11, the copies are removed one at a time from the interim storage unit 40, transported over path 44, thence to input path 27 for receiving a second image, as previously described. The two-image duplex copies are then transferred into output portion 14. Gate 42 is a diagrammatic showing representative of any one of a large plurality of sheet deflecting or directing apparatus usable for the stated purposes.

Preentry switch 60 senses that an original document has been placed in input tray 11B for entry into SADF 11. This condition is defined as "ORGATDF". The condition is signalled to logical connective 53 which then actuates SADF 11, as later described, to transport the inserted original document up to the entry gate 63. As the original document is being transported onto the document glass 11A, entry sensor 61 senses the presence of the original document. During normal operation, the trailing edge of the document will be first sensed by sensor 60 indicating that the document is no longer at the preentry position. Finally, the trailing edge will be sensed by entry sensor 61 as it leaves the entry area and is placed on the imaging area of document glass 11A. In the event that an operator retrieves the original document before it is completely inserted on the document glass 11A, entry sensor 61 will sense that the leading edge has been moved away from the entry position prior to the time that the preentry sensor 60 senses that no document is in the preentry position. This latter sequence of events signals to the logical connective 53 that the original document has been removed and that no copy should be produced by CPP 13. Accordingly, logical connective 53 inhibits CPP 13 by not initiating a copy production run. Upon reinsertion of the original document or a different document, the normal start-up procedures based upon the sensing of documents at sensors 60–61 is followed. The above procedures prevent CPP 13 from inadvertently producing a blank copy when an original document has been removed from the document feed.

CPP 13 also has second or alternate copy paper supply 54 which supplies copy paper to input path 27 via paper path 55. Selection of paper supply 35 or 54 as a copy paper source is controlled from panel 52 by actuation of switches 56. Selection is mutually exclusive. Logical connective 53 responds to switches 56 to actuate a paper picker (not shown) in the respective copy paper supplies 35, 54 in a usual manner.

Figure 2:
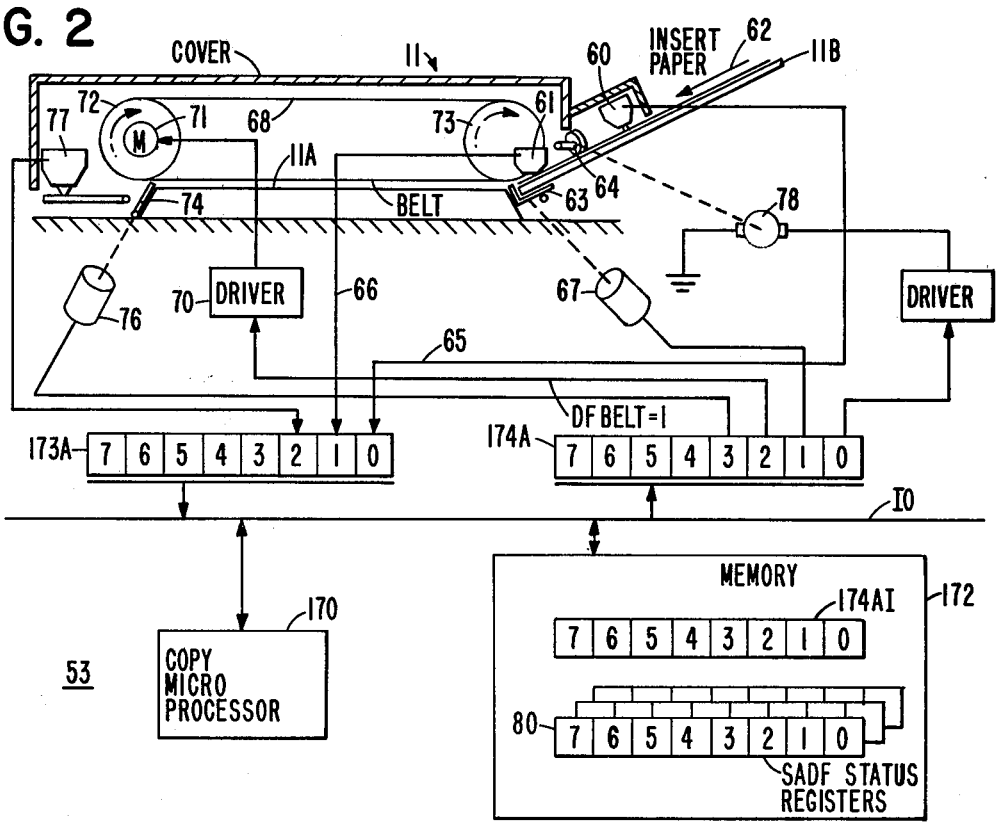
FIG. 2 is a partial diagrammatic showing of the FIG. 1 machine accenting the interactions between the semiautomatic document feed (SADF) and associated control circuits.

FIG. 2 illustrates the SADF 11 and its essential connections to logical connective 53 for practicing the present invention. As shown, original document 62 has been placed on input tray 11B, entry gate 63 has not yet been opened; however, entry aligner roll 64 has aligned original document 62 against entry gate 63. Accordingly, both preentry sensor 60 and entry sensor 61 are active (sense original document 62). These conditions are signalled by the two sensors, respectively, over lines 65 and 66 to logical connective input register 173A, bit positions 0 and 1. A copy microprocessor 170 periodically scans input register 173A or can be actuated by an interrupt (not described) for sensing that original document 62 is at the illustrated position. In response to sensing the above conditions and assuming that predetermined copy production status of the copy production machine 10 is satisfied, copy microprocessor 170 supplies control signals to output register 174A for opening gate 63. This action is achieved by setting bit position 1 of register 174A to the active state. As a result, an activating signal supplied from bit position 1 of register 174A to gate solenoid 67 pulls the gate down and allows the original document 62 to be picked up by the SADF transport belt 68. Belt 68 was activated by copy microprocessor 170 at the same time as gate 63 was opened by setting bit position 2 of register 174A to the active state for activating driver 70 to actuate SADF motor 71 for moving the belt over rollers 72 and 73. As belt 68 engages original document 62, the document moves over the top of document glass 11A against exit gate 74 at the left hand side of document glass 11A. As soon as the document 62 is on the document glass, copy production can begin. Copy microprocessor 170 then actuates CPP 13 in a known manner via an output register 174 (FIG. 4), whereupon input optics 12 scans the document on document glass 11A and causes a transfer of image to copy paper as previously described. The belt 68 is stopped by copy microprocessor 170 deactivating motor 71.

When original document 62 moved onto document glass 11A, preentry sensor 60 first indicated paper had left and then entry sensor 61 indicated the document 62 had left that position. When both sensors indicate the above sequence, copy microprocessor 170 reacts to initiate a copy production cycle.

Upon completion of the copy production cycle, exit gate 74 is opened by microprocessor 170 actuating bit 3 of output register 174A to actuate solenoid 76 which frees original document 62 to be exited past exit sensor 77 into an original document exit tray (not shown). When exit sensor 77 senses the leading edge of original document 62, it supplies a signal to input register 173A signifying to copy microprocessor 170 that the original document 62 is being successfully exited to the original document exit tray (not shown). At this time a second original document on input tray 11B may be entered onto document glass 11A. Alternately, the trailing edge of the exiting document may be sensed.

Input aligners 64 are rotated by motor 78 as actuated by bit position 0 of output register 174A. These aligners are activated whenever input sensor 60 senses documents 62 being inserted on input tray 11B and other copy production prerequisites are met. The rollers 64 are maintained in the active position until entry sensor 61 senses the alignment of original document 62 or a timer (not shown) times out and a document feed error is signalled.

The arrangement of logical connective 53 is such that the output register 174A cannot be sensed by copy microprocessor 170. That is, registers 173A and 174A have the same address except that 174A is addressed during an output mode of the copy microprocessor 170 while input register 173A is accessed during an input mode. Copy microprocessor 170 must know the signal contents of output register 174A at all times. Accordingly, it provides an image of the signal content of output register 174A in main memory 172 at all times. One of the registers within main memory 172 is designated by numeral 174AI for the image of the signal content of output register 174A. In this manner, the copy microprocessor, by reading register 174AI, can immediately determine the control status being supplied to the SADF 11 as well as other portions of the copy production machine 10 from other output 174 registers. Additionally, certain work registers are assigned to work within memory 172 for the convenience of copy microprocessor 170 in controlling the operation of SADF 11. These are called SADF status registers 80, the signal content of which will be described later with respect to a description of the microcode used to operate copy microprocessor 170 in implementing the invention in copy production machine 10. Logical connective 53 will be further described later with respect to FIGS. 4 through 10.

Figure 3:
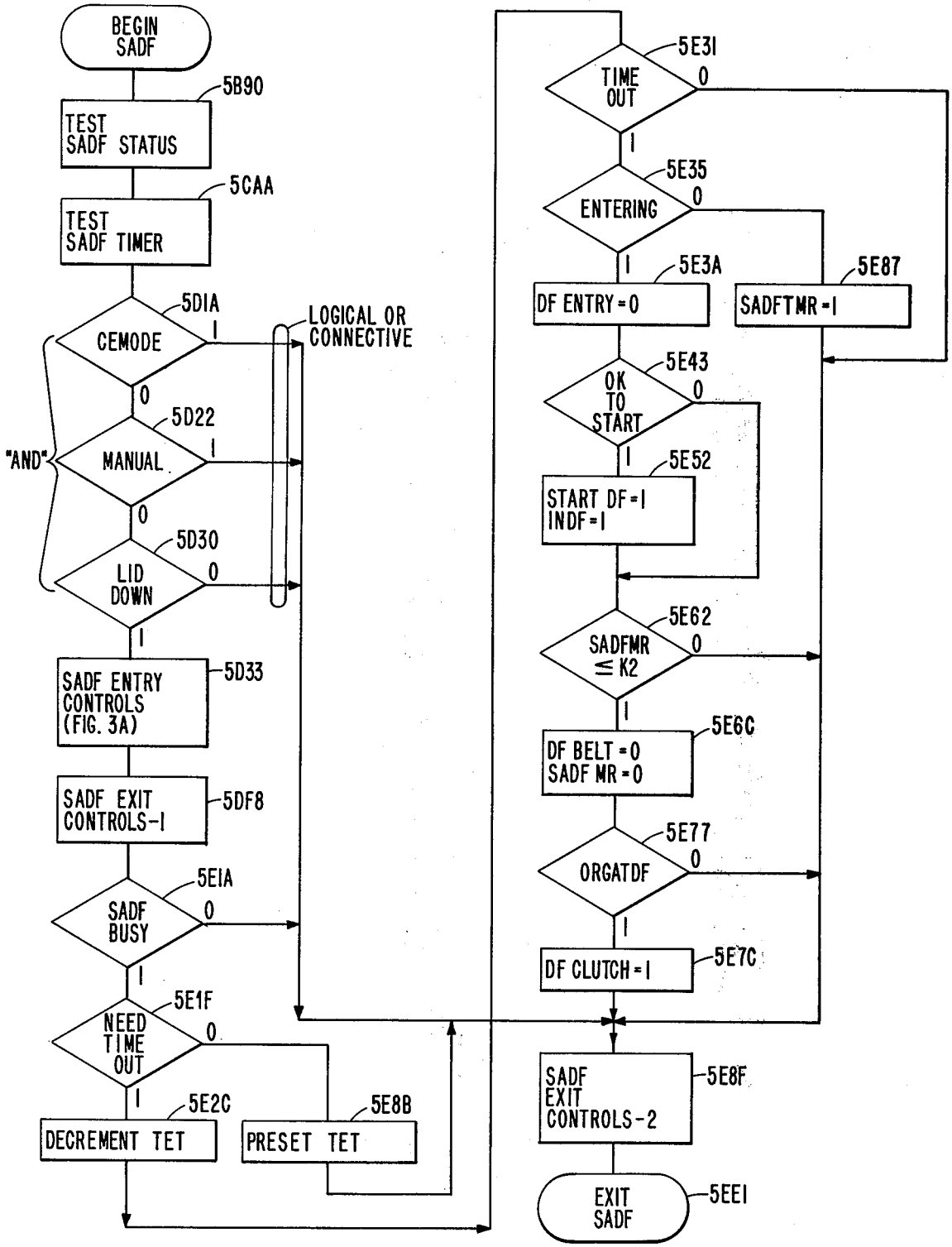
FIG. 3 is a flow chart illustrating the operation of the copy production machine while controlling the SADF and responding to SADF indicated conditions.
Figure 3A:
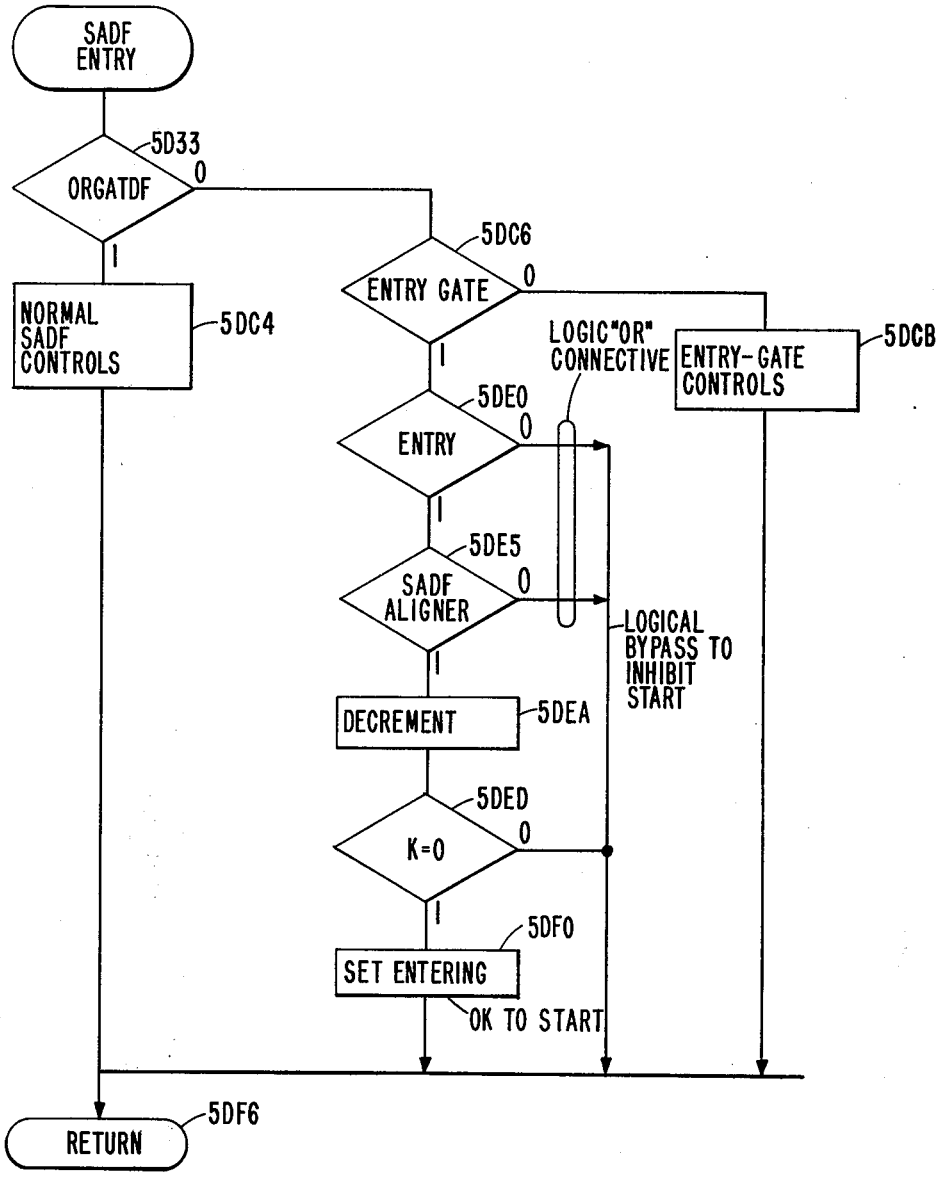
FIG. 3A is a flow chart illustrating a detailed portion of the SADF entry controls of the FIG. 3 illustrated flow chart.

Before proceeding with a detailed description of the logical connective hardware, the operation of that connective including copy microprocessor 170 is described in detail with respect to FIGS. 3 and 3A and the tables of program instructions in Appendices A, B and C which contain a source code listing corresponding to the instructions illustrated by the FIGS. 3 and 3A flow charts. The critical parts of the two flow charts are at instruction level, but the remaining parts are at a gross level for simplifying the description and enabling a better understanding of the invention. Also not described is the executive system in copy microprocessor 170. Since such executive systems are well known, a description thereof is dispensed with for the sake of brevity. It is understood that any form of calling subroutines may be employed for initiating the execution of programs represented by FIGS. 3 and 3A flow charts for the successful practice of the invention. The enumeration of the flow chart boxes are in accordance with the memory locations of the instructions shown in the Appendices.

The program that controls SADF 11 is termed SADF. The first instruction is at 5B90 for testing SADF status, that is, certain conditions within copy production machine 10 would indicate that SADF 11 should not be operated. For example, SADF 11 may have a pivoted lid which carries the original document transport belt 68. When the lid is up, the copy production machine 10 is in a so-called manual mode of operation, and when the lid is down it can be in the semiautomatic mode of operation. Therefore, if the lid is up, then the SADF should not be operated. Further, if the SADF is busy transporting a document such as when both receiving and exiting documents, then further controls should be inhibited until that operation is completed. Also, if there is no original document 62 at the preentry or at the entry switch positions, then there may be no need for going through the program and it can be dispensed with for saving computer time on copy microprocessor 170. Other inhibits would be jams in the copy production machine and other inabilities of the copy production machine to receive a document on document glass 11A.

Upon a successful completion of the status testing, certain time-out timers are tested for improper machine operation indications beginning at memory location 5CAA for insuring reliable operation of copy production machine 10. A plurality of timers are employed to detect improper operation. For example, aligner 64 can be operated for a limited time to ensure that the original document does not crumple up in the case of a misfeed. Similarly, the original document driving belt 68 is operated only for a limited time, after which time the exit sensor 77 or the sensors 60–61 must have reached the predetermined indicating state. Therefore, the test SADF timer routine looks for error conditions within SADF 11.

Upon completion of the SADF timer test, the copy microprocessor 170 checks three conditions, respectively, at 5D1A, 5D22, 5D30. The source code for these three conditions is shown in Appendix A. If the copy production machine is in the CE mode or is in a manual mode, or the lid is not down, then the program is exited to 5E8F and thence 5EE1. The three exits from the three branches 5D1A, 5D22, 5D30 are a logical "OR" connective. To continue on the program, a logical AND connective must be satisfied for executing the instruction at 5D33 which begins the segment of the program entitled SADF entry controls, which is shown in detail in FIG. 3A and constitutes a showing of how the invention is implemented in copy machine 10.

The source code for FIG. 3A is shown in Appendix B, as well as in flow chart form in FIG. 3A. The first instruction of the SADF entry segment is at 5D33 which senses preentry switch 60 for detecting whether or not an original is at the document feed (ORGATDF). If it is, normal SADF controls are executed in the instructions residing between memory locations 5D38 and 5DC4 which then returns the copy microprocessor 170 to 5DF6 of FIG. 3. On the other hand, if pre-entry switch 60 indicates no original at the document feed, the entry gate status is checked at 5DC6. This is done because the SADF entry segment of the programming should not be entered unless a document is to be entered. The entry gate check at 5DC6 being a zero branches the program of copy microprocessor 170 to execute the entry gate control beginning at memory location 5DCB which is beyond the scope of the present description. The program would then exit to 5DF6 of FIG. 3. If the entry gate is in the one state, i.e., actuated to admit an original document, then the branch instruction at 5DE0 is executed. This branch instruction determines whether or not the document can be entered; for example, it determines whether an original is in the document feed and the aligner motor has not yet been turned off. If not, the program branches to 5DF6 without enabling the SADF 11 to enter a document. This action indicates that an operator (not shown) is either pulling a document from SADF 11 or is just inserting a document to be copied. Other code determines which situation is occurring. The branch to 5DF6 from 5DE0 the set entering routine at 5DF0 to inhibit copy production start-up until it is certain a document to be copied will be on document glass 11A.

On the other hand, if the 5DE0 branch is a one, copy production could ensue. The SADF aligner status is checked at 5DE5. That is, the two conditions are represented by the two branch instructions entry and SADF aligner. If both these conditions are satisfied, a logic "AND" connective, then at 5DEA is effected and count controlling the timeout on the aligner motor is decremented. This count controls the length of time that the aligner operates. If either of the conditions are not true, a logical "OR" connective is effected and then the recovery control path is used for branching to 5DF6. This recovery control path bypasses the control that enables SADF 11 to be prepared. SADF 11 is started for moving the original document from the entry position to the document glass by the instruction at 5DF0 which sets "entering" which then enables other programs to turn on SADF 11. SET ENTERING is executed only when the aligner motor has operated for a predetermined time as determined by the branch instructions 5DE5 or 5DED for checking the count equal to zero. If it is not zero, then the aligner motor 71 has not yet stopped, and 5DF6 is executed.

The "set entering" flag of 5DF0 resides in a bit position of register 80 of memory 172 (FIG. 2). This bit is tested at 5E35 of FIG. 3 as will be later described.

From instruction 5DF6 the routine shown in FIG. 3 is reentered at instruction 5DF8 in a subroutine called SADF exit controls-1. These controls monitor the exit of an original document from SADF 11, close the exit gate and turn off the document feed belt 68; i.e., turn off motor 71.

From SADF exit controls-1 the copy microprocessor 170 then executes instruction at 5E1A to determine whether the SADF 11 is busy. The code corresponding to the instructions in this area are shown in Appendix Table C "SADF Control". If the SADF 11 is not busy then the program is exited to SADF exit controls-2 at 5E8F. If, on the other hand, the SADF status register 80 of memory 172 indicates that SADF 11 is busy, then instruction at 5E1F is executed. This instruction determines whether a timeout is needed for operating SADF 11. This branch, as shown in the Appendix C code, ascertains whether there is an original in the document feed, whether the document feed belt is active, whether an original document is being exited; if any condition is true, a timeout is needed. Otherwise, no timeout is needed. Accordingly, at 5E1F a binary zero (latter case) causes the SADF 11 count field TET (trailing edge timer) to be preset at 5E8B to a predetermined number corresponding to the desired timeout. This timeout relates to time for detection of the trailing edge of a document being received onto document glass 11A. If a timeout is needed, then at 5E2C copy microprocessor 170 decrements the SADF 11 TET counter. If no timeout is needed, then the SADF exit controls-2 at 5E8F are entered since no further control of SADF 11 is necessary. On the other hand, from decrement TET at 5E2C the instruction at 5E31 is executed. This determines whether the SADF 11 timer TET has timed out. If it has not, timed out the aligner motor still is to run and that that the original document being entered has not yet been properly aligned or is not completely on the document glass. Accordingly, SADF exit controls-2 is then entered at 5E8F from 5E31. On the other hand, if the aligner has timed out which indicates the original document can be entered, then the instruction at 5E35 determines whether the entering status bit of register 80 in memory 172 has been set. If not, the copy microprocessor 170 branches to 5E87 to set on the SADF timer (SA0FTMR=1). From 5E87 copy microprocessor 170 goes to 5E8F. On the other hand, if "entering" has been set to the active condition, then at 5E3A copy microprocessor 170 sets DFENTRY=0 (close entry gate 63 or copier is in manual mode—SADF 11 is inactive) in the status register 80. From 5E3A the copy microprocessor 170 determines at 5E43 whether it is ready to start the copier machine 10. This is determined by the SADF timer being less than or equal to a predetermined constant, there having been no inhibit document feed or a current original document still not being exited. If any one of those three conditions is true, then the instruction at 5E62 is executed. If the SADF is to be started then 5E52 sets the start document feed latch to one (register 80) and sets the inhibit document feed to one so that additional starts will not occur. Then 5E62 is executed which determines the status of the SADF motor, i.e., how long the motor has been running. If it has not been running long enough, then 5E8F is entered. If, however, it has been running long enough to position the document on the document glass, then at 5E6C the document belt motor 71 is turned off by setting DFBELT=0 and the SADF motor is turned off by setting SADFMR=0. From 5E6C the computer senses for an original document at the original document feed at 5E77. If there is an original document at the document feed, i.e., switch 60 is closed, then the document input aligner 64 motor 78 is activated at 5E7C and then 5E8F is entered. If there is no document, then 5E8F is entered. As an alternate embodiment, motor 78 can be omitted. Motor 71 can be coupled to aligner 64 via a belt (not shown). Aligner 64 can be braked by a friction clutch (not shown) to the SADF frame. To actuate aligner 64, the clutch would be released, allowing aligner 64 to operate immediately.

The SADF exit controls-2 are next executed which are miscellaneous control functions not necessary to an understanding of the present invention. Finally, the entire SADF routine is exited at 5EE1 to return to an operating or executive control system for operating the entire computer, to an interrupt level below the SADF interrupt level, or to an idle scan type of loop.

PROCESSOR CONTROL SYSTEM

Programmed logical connective 53 includes a programmable computer control system as shown in FIG. 4. Single chip microprocessor CMP 170 operates based upon a set of control programs contained in ROS control store 171 and uses working store or memory 172 as a main or working store. CMP 170 communicates with the other units of circuits 53A as well as with CPP 13, SADF 11, output portion 14 and control panel 52, as later discussed, via the input registers 173 and output registers 174. In a preferred constructed embodiment, IO bus is eight bits wide (one character) plus parity. Address signals, selecting which units are to send or to receive signals with respect to CMP 170, as well as the other units, are provided by CMP 170 over a sixteen bit address ADG. A nonvolatile store CMOS 175 is a battery powered semiconductor memory using CMOS construction and powered a battery 175B. A clock 176 supplies later described timing signals to units 170–175.

In FIG. 5, the logical interconnections between microprocessor 170 with controlled units 171–175 are shown. All of the signals on the busses and individual control lines go to all units with the ADC signals selecting which controlled unit 171–175 is to respond for either receiving data signals or supplying data signals, respectively, via bus IO. Control line I/O indicates whether CMP 170 is supplying or receiving signals over bus IO. When the I/O line carries a binary one, data or instruction signals are to be transferred to the microprocessor 170 over IO. When it carries a binary zero, microprocessor 170 supplies data signals over IO. Write line WRT indicates to memory 172 that signals are to be stored in the memory. The signal IIP indicates interrupt in progress, i.e., the microprocessor 170 program has been interrupted and microprocessor 170 is handling that interrupt. The SDL (data latch) signal is received from system clock 176 indicating that data signals from IO are to be latched in microprocessor 170. The line SK means sliver-killer which is a control signal for eliminating extraneous signals commonly referred to as slivers. These so-called signals result in interaction between successively actuated bistable circuits termed latches. Other timing signals for coordinating operation of all of the units 171–175 are received from system clock 176. Additionally, power on reset circuit POR activates system clock 176 to send out timing signals and control signals for resetting all of the units 170–175 to a reference state as is well known in the computer arts.

THE MICROPROCESSORS 62 AND 170

Figure 6:
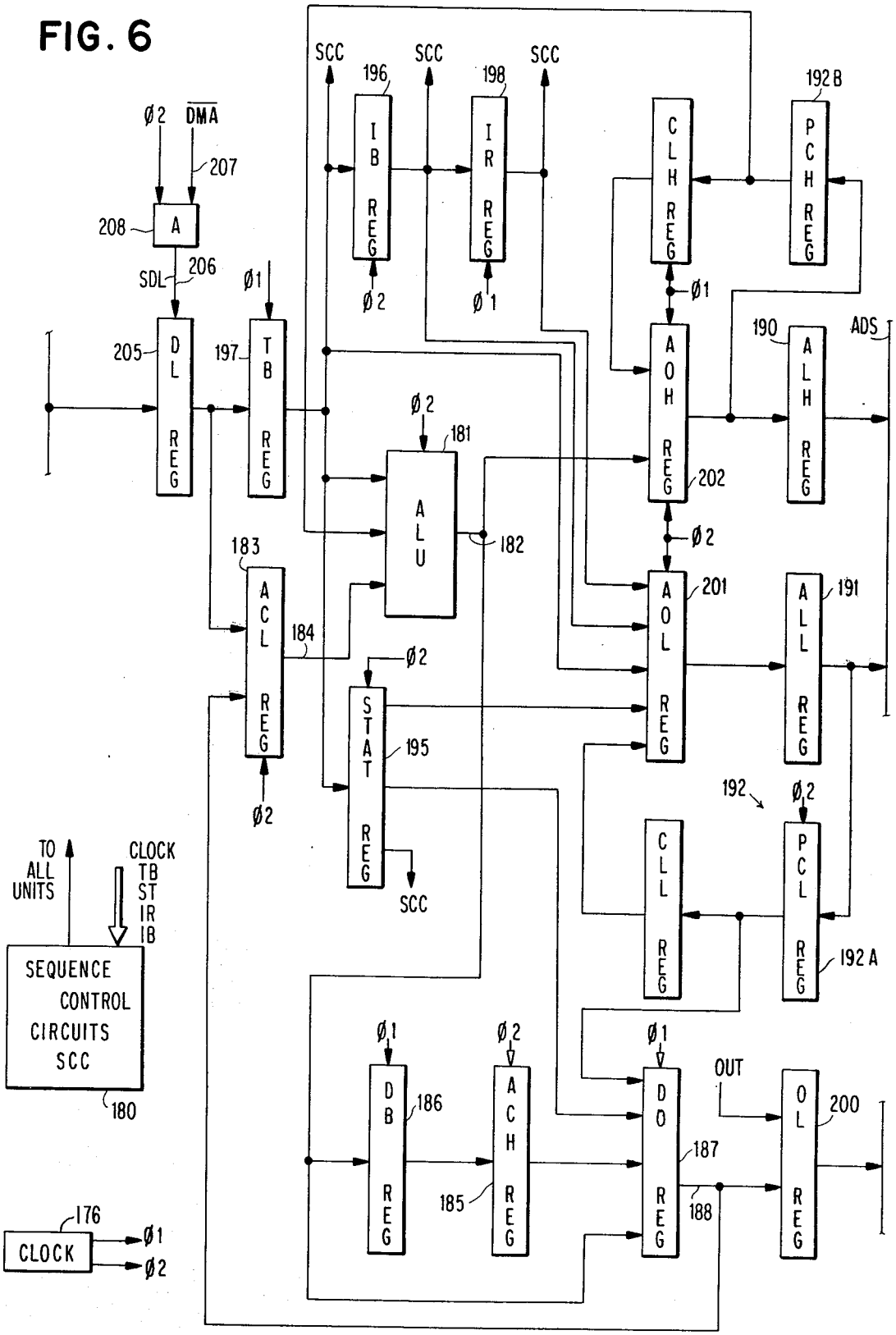
FIG. 6 is a data flow diagram for a microprocessor used in the FIG. 4 illustrated system.

In FIG. 6, the data flow of the microprocessor 170 is detailed. The data flow and operation of SMP 62 are identical. The sequence control circuits 180 are those logic circuits designed to implement the now to be described functions performable in the timing context of the following description. Such sequence control circuits SCC 180 include instruction decoders, memory latches and the like, for sequencing the operation of the FIG. 6 illustrated data-flow circuits using two-phase clock, signals $\phi 1$ and $\phi 2$ from clock 176. The processor contains an eight bit (one character) arithmetic and logic unit ALU 181. ALU 181 receives signals to be combined during a $\phi 2$ signal and supplies static output signals over ALU output bus 182 during each $\phi 1$ signal. Operatively associated with ALU 181 is a sixteen bit accumulator consisting of two registers, a low register ACL 183 which has its output connections over eight bit bus 184 providing one input operand to ALU 181. The second register of the accumulator is ACH register 185. When the microprocessor 170 operates with a two character or two byte word, the functions of ACL 183 and ACH 185 alternate. That is, in a first portion of the operation, which requires two complete microprocessor cycles, as later described, ACL 183 contains the eight low order bits of a sixteen bit word, and ACH 185 contains the eight high order bits of the sixteen bit word. ALU 181 first operates on the eight lower order bits received over ACL bus 184 and supplies the result signals over ALU output bus 182 to DB register 186. During this operation, ACH 185 is supplying the eight high order bits through DO register 187, thence over DO bus 188 to ACL 183. During the next ALU cycle, the eight high order bits are operated upon. In the preferred and constructed embodiment, ALU 181 operates with two's-complement notation and can perform either eight bit or sixteen bit arithmetic as above described. Eight bit logical operations are also performed.

ALU 181 contains three indicating latches (not shown) which store the results of arithmetic and logical functions for use in later processor cycles such as conditional jumps or branches and so-called input carry instructions. These three indicators are low, equal (EQ), and carry. Utilization of these indicators will be better understood by continued reading of the specification. Processor sequence control circuits 180 can handle a single level of interrupt and include an internal interrupt mask register (not shown) for inhibiting interrupts as is well known in the computer arts. The address signals are supplied to bus ADS by the ALH register 190 (high order bits of the address) and ALL register 191 (the low order eight bits of the address), designated as work registers. These registers are divided into sixteen groups of sixteen two byte registers. A portion of ALL register 191 supplies GP signals for selecting which groups of registers are accessible by microprocessor 170.

As will be later detailed, microprocessor 170 requires two processor cycles for processing an I/O instruction. The first cycle is a set-up cycle and the second cycle is a data transfer cycle. When an I/O operation requires a transfer of a succession of bytes, the first cycle sets up a unit 171–175 for transferring a plurality of bytes such that the I/O operation appears as a set-up cycle followed by a plurality of data transfer cycles. The microprocessor 170 is designed to operate with a plurality of relatively slow acting devices;, e.g., copy production machine 10. The time required for the microprocessor 170 to perform its functions is relatively short compared with the time required by the controlled devices. Accordingly, under clock 176 control, the microprocessor 170 can be effectively turned off to allow a controlled device to have exclusive use of the IO bus.

From examination of FIG. 6, it can be seen that all of the registers, being latches, will maintain their respective signal states whenever the clock signals, $\phi 1$ and $\phi 2$, are not supplied. Therefore, upon an interruption of the microprocessor 170 by a controlled device 171–175, the signal state of the processor 170 enables it to continue operating again as if there had been no interruption.

The other registers in the microprocessor 170 are described with the instructions set for facilitating a better understanding of the interaction of these registers. The microprocessor employs instructions of variable length, 1, 2, or 3 bytes. The first byte of any instruction always includes the operation code, while succeeding bytes, numbered 2 or 3, contain address data or immediate operand data.

The fastest instruction execution requires one microprocessor cycle while the longest instruction requires six processor cycles. An interrupt requires ten cycles to process. In all designations, bit 0 is the least significant bit.

INSTRUCTION REPERTOIRE

The instruction repertoire is described in groups of instructions, all of which have defined instruction word formats. The instructions are defined by the title, mnemonic, number of cycles required by the microprocessor to execute the instruction, number of operands (OP), and the number of bytes in the instruction word. Additionally, breakdown of the command structure of the first byte is given.

REGISTER ARITHMETIC

| Instruction | Mnemonic | Cycles | OP | Bytes |
|---|---|---|---|---|
| Add | AR | 3 | 1 | 1 |
| Subtract | SR | 3 | 1 | 1 |
| Load | LR | 3 | 1 | 1 |
| Store | STR | 3 | 1 | 1 |
| Load/Decrement | LRD | 5 | 1 | 1 |
| Load/Bump | LRB | 5 | 1 | 1 |

The instruction byte is divided into two portions. The most significant four bits indicate the instruction code and the least significant four bits select a register within a group of sixteen registers as the operand source. All results are stored in the accumulator register. The Register Arithmetic is two-byte arithmetic.

BYTE ARITHMETIC

| Instruction | Mnemonic | Cycles | OP | Bytes |
|---|---|---|---|---|
| Add | AB | 3 | 1 | 2 |
| Subtract | SB | 3 | 1 | 2 |
| Load | LB | 3 | 1 | 2 |
| Store | STB | 3 | 1 | 2 |
| Compare | CB | 3 | 1 | 2 |
| And | NB | 3 | 1 | 2 |
| Or | OB | 3 | 1 | 2 |
| Xor | XB | 3 | 1 | 2 |

The most significant byte of the instruction indicates the instruction command. The second byte indicates one of 256 byte addresses in memory to be used in the arithmetic operation. The difference between register arithmetic and byte arithmetic is that byte arithmetic obtains the operand from memory.

IMMEDIATE ARITHMETIC

| Instruction | Mnemonic | Cycles | OP | Bytes |
|---|---|---|---|---|
| Add | AI | 2 | 1 | 2 |
| Subtract | SI | 2 | 1 | 2 |
| Load | LI | 2 | 1 | 2 |
| Compare | CI | 2 | 1 | 2 |
| And | NI | 2 | 1 | 2 |
| Or | OI | 2 | 1 | 2 |
| Xor | XI | 2 | 1 | 2 |
| Group | GI | 2 | 3 | 2 |

The format is the same as for byte arithmetic with the second byte being the operand data. In the last instruction, Group, GI, the immediate data selects the registers in the register group as will become apparent.

ACCUMULATOR ARITHMETIC

| Instruction | Mnemonic | Cycles | OP | Bytes |
|---|---|---|---|---|
| Add 1 | A1 | 2 | 0 | 1 |
| Subtract 1 | S1 | 2 | 0 | 1 |
| Shift Left | SHL | 2 | 0 | 1 |
| Shift Right | SHR | 2 | 0 | 1 |
| Clear | CLA | 1 | 0 | 1 |
| Transpose | TRA | 1 | 0 | 1 |
| Input Carry | IC | 1 | 0 | 1 |

All eight bits of byte 1 are used to denote the function to be performed. All operations are conducted within the accumulator. Transpose instruction, TRA, swaps the high and low order register contents of accumulator registers 183 and 185.

INDIRECTS

| Instruction | Mnemonic | Cycles | OP | Bytes |
|---|---|---|---|---|
| Store | STN | 4 | 1 | 1 |
| Load | LN | 4 | 1 | 1 |

This is an indirect addressing set of instructions wherein the most significant five bits indicate the function and the least significant three bits signify which of eight registers contain the address in memory to be accessed.

BIT CONTROL

| Instruction | Mnemonic | Cycles | OP | Bytes |
|---|---|---|---|---|
| Test/Preserve | TP | 1 | 1 | 1 |

-continued

| BIT CONTROL Instruction | Mnemonic | Cycles | OP | Bytes |
|---|---|---|---|---|
| Test/Reset | TR | 1 | 1 | 1 |

The five most significant bits of the instruction byte indicate the function while the three most significant bits indicate the accumulator bit to be tested.

| INPUT/OUTPUT Instruction | Mnemonic | Cycles | OP | Bytes |
|---|---|---|---|---|
| Input | In | 4 | 1 | 2 |
| Output | OUT | 4 | 1 | 2 |

These two instructions use the first byte as a command and the second byte to address one of the possible addresses on the busses, MI, DI, or IO.

| BRANCHES Instruction | Mnemonic | Cycles | OP | Bytes |
|---|---|---|---|---|
| JUMP | J | 3 | 1 | 1 |
| JUMP NOT EQUAL | JNE | 3/1 | 1 | 1 |
| JUMP EQUAL | JE | 3/1 | 1 | |
| BRANCH | B | 3 | 1 | 2 |
| BRANCH NOT EQUAL | BNE | 3/2 | 1 | 2 |
| BRANCH EQUAL | BE | 3/2 | 1 | 2 |
| BRANCH HIGH | BH | 3/2 | 1 | 2 |
| BRANCH AND LINK | BAL | 6 | 2 | 3 |
| RETURN | RTN | 5 | 1 | 1 |
| INTERRUPT | — | 10 | | — |

The first three JUMP instructions identified by the three most significant bits. A fourth bit indicates whether the four least significant bits, indicating the jump length, designate forward or backward jump. The plus indication, the binary 0 while the minus indication is a binary 1.

In the branch instructions, except for the BRANCH AND LINK, the most significant four bits with the least significant bits two of the first byte indicate the functions. The other two bits indicate whether 256 is to be added or subtracted from the high address positions or not changed. The BRANCH AND LINK, a three-byte instruction, selects one of four registers with the lower two bits of the first byte and uses the most significant six bits as a function indicator. The other two bytes are a fifteen bit address for designating the branch address, the second byte being the eight least significant bits and the third byte being the seven most significant bits. The RETURN instruction is a one-byte instruction having a similar format as the BRANCH AND LINK command byte. The interrupt is not an instruction, but a routine activated signal received over interrupt by a request line INT.

ALU CONDITION CODES

The table below indicates the condition code in the ALU low, equal (EQ), or carry set as a result of the executed class of instructions as set forth in the table below.

| Instruction Class | Low | Equal (EQ) | Carry |
|---|---|---|---|
| Register Arithmetic | 16th bit = 1 | All bits (0-15) = 0 | Carry from 16th bit |
| Byte Arithmetic | 8th bit = 1 | All bits (0-7) = 0 | Carry from 8th bit |
| Bit Control | All bits exclusive of bit being tested = 0 | Tested bit = 0 | Unchanged |
| Shift Left | All bits = 0 | 0 was shifted out of the 16th bit | 1 was shifted out of the 16th bit |
| Shift Right | All bits = 0 | 0 was shifted out of the 1st bit | 1 was shifted out of the 1st bit |
| *Logical OR | Results of OR equals all ones | Bits set by OR were all 0's | Unchanged |
| **Logical AND | Preserved bits are all ones | Result of AND equals all 0's | Unchanged |
| Logical XOR | Result all ones | Result all zeroes | Unchanged |
| Input | All bits exclusive of bit 8 = 0 | 8th bit = 0 (Data Input and Output) | Unchanged |
| Input Carry | Always Reset | Carry = 0 | Unchanged |
| Compare | Number compared is greater than the byte of accumulator | Number compared equals the contents of the low byte of accumulator | Carry from 8th bit |

*Test the set of bits (set by "OR") to be all 0's, and the result for all ones. Does TBS of individual bits. The set bits are indicated by ones in the mask (logical OR).

**Test the preserved bits to be all zeros, all ones, or mixed. The preserved bits are indicated by ones in the mask (logical AND).

A Jump instruction does not modify the accumulator 183, 185 or indicator bits whether taken or not. The program counter has had one added to it since it addressed the jump instruction. The program counter 192 includes PCL register 192A and PCH register 192B, hereinafter referred to as counter 192. If a jump is taken, the least significant four bits of the instruction replace the least significant four bits of the program counter 192 and the most significant eleven bits are modified if indicated. The range of the instruction address change is −15 to +17 bytes measured from the jump instruction address. If the destination is within this range, it is only necessary to specify the least significant four bits absolutely of the destination address and to use a bit to describe the direction (0 for +2 to +17 or 1 for −15 to +0, the +1 condition is not realizable). The +1 condition is not useful because the processor goes to +1 if the jump is not taken. Therefore, if it was valid the processor would go to +1 if the jump was taken or not.

In a branch instruction, the program counter 192 has been incremented to point to the second byte of the branch instruction word. The least significant eight bits absolute of the destination program address are coded in the data byte (second byte). A code to modify the most significant seven bits of the program counter is coded into the instruction byte to leave the high seven bits the same, to add one most significant, or substract one (plus 256 or minus 256).

Branch on Equal and Branch on Not Equal test only the condition of the ALU 181 EQ indicator. Branch on Not Low tests only the condition of the Low indicator. Branch on High requires that both the EQ and Low indicators be reset.

The BRANCH AND LINK instruction is an unconditional branch that specifies the fifteen bit absolute branch address of the program destination and a two bit number indicating a register to be used. The address of the next executable instruction (following the BAL) is stored in the register specified by the two bit number.

Interrupt is not a programmable instruction but is executed whenever the Interrupt Request line INT is activated by an external device and an Interrupt mask in STAT register 195 is equal to zero. Interrupt stops the execution of the program between instructions, reads the new status (register group, interrupt mask, EQ, LOW, CARRY) from the high byte of REGISTER 8, stores the old status in the low byte of REGISTER 8, stores the address of the next instruction to be performed in REGISTER 0, stores the accumulator in REGISTER 4 (without altering the accumulator), and branches to the address specified by the contents of REGISTER 12. The processor always specifies REGISTER GROUP 0 for interrupt. Interrupt requires ten processor cycles to complete. Register groups will be later described.

Return is an unconditional branch to a variable address stored in a register specified by the instruction and can be used in conjunction with the BRANCH AND LINK to return to the main program after having been interrupted. Two bytes are read from the specified register to define the absolute branch address. A return using register $\phi$ of register group $\phi$ is defined as a return from interrupt. In this, the new status (EQ, LOW, CARRY, interrupt mask and register group) is read from the low order byte of REGISTER 8.

Arithmetic Group instructions operate with the sixteen bit accumulator 183, 185 and eight bit arithmetic-logic unit ALU 181 that are capable of performing various arithmetic and logical operations. Three condition indicators (LOW, EQ, CARRY) are set according to the results of some operations. Two's-complement sixteen bit arithmetic is performed except for byte operations and some immediate operations which are two's-complement eight bit operations. The high order bit is the sign bit; negative numbers are indicated by a one in the sign bit position. Subtraction is accomplished by two's-complement addition. Any arithmetic operation that results in a CARRY will set the CARRY latch even though the accumulator may not be changed.

Double Byte Arithmetic is performed with registers 0–15 of the current group for the Add, Subtract, Load and Store instructions. Load Register and Bump (add +1) uses registers 4–7 and registers 12–15. Load Register and Decrement uses registers 0–3 and registers 8–11. In the add register and subtract register instructions, AR and SR, the sixteen bits of the addressed or specified register are added to or subtracted from the accumulator and the result is placed in the accumulator. EQ is set if the result is all zeroes. Low is set if the high order bit is a one.

Load Register instruction LR loads the sixteen bit contents from the specified register into the accumulator 183, 185. The contents of the addressed register are unchanged. The ALU 181 indicators are not altered. The Store Register instruction, STR, stores the sixteen bit contents from the accumulator 183, 185 into the specified register. The contents of the accumulator 183, 185 and the ALU 181 indicators are not altered.

In the Load Register and Bump, LRB, and Load Register and Decrement, LRD, instructions, an absolute one is added to or subtracted from the contents of the specified register, respectively. The result is placed in the accumulator 183, 185 and the specified register. The indicators are updated as for an add or subtract, AR or SR.

For the Byte Arithmetic instructions, bytes 0–511 of memory 64 are addressable by the Byte Arithmetic instructions. The directly addressable memory 172 is divided into sections: bytes 0–255 which are addressable when register groups 0–7 are selected; and bytes 256–511 which are addressable when register groups 8–15 are selected. Bytes 512–767 and 768–1023 are two additional groups. This sectioning yields 32 register groups in memory from which the processor operates.

In the instructions AB, SB, CB, LB and STB, the eight bit contents of the specified byte are added to, subtracted from, compared with, loaded into, or stored from the accumulator register ACL 183, respectively. The high order byte of the accumulator in ACH Register 185 is not disturbed. The ALU 181 condition indicators are set on the result of the single byte arithmetic: add, subtract, and compare. The results of all of the byte operations except compare CB and store STB are placed in the accumulator register 183. Store alters the specified byte in the active byte group. Compare is a subtract operation that does not alter the contents of the accumulator 183, 185. Byte arithmetic is eight bit signed arithmetic.

In the byte NB, OB and XB instructions, the specified byte is logically ANDed, ORed, or EXCLUSIVE-ORed with the accumulator register 183 contents, respectively. The result is kept in the accumulator register 183. The EQ ALU 81 indicator is set:

for the AND operation if the result of the AND equals all 0's;

for the OR operation if the bits set by the OR were all 0's; and for the EXCLUSIVE-OR operation if there is identity between the byte and accumulator (result=all 0's). The LOW indicator is set:

for the AND operation if the preserved bits are all 1's; and for the EXCLUSIVE-OR operation if the byte and accumulator are bit for bit opposites (result=all 1's). The logical AND can test the selected mask to be all zeroes, all ones, or mixed. The selected mask bits are indicated by ones in the corresponding positions of the byte used as the mask. The logical AND tests the bits that are preserved, and the logical OR tests the bits that are set to in the result one. If only one bit is selected then the logical OR does a test bit and set.

The Immediate Arithmetic instructions AI, SI, CI, LI, NI, OI and XI are the same as the byte operations except that eight bits of immediate data are used instead of the contents of an addressed byte and the Add and Subtract operations are sixteen bit signed arithmetic rather than eight bit signed.

The Group Immediate instruction GI takes eight bits of immediate data to alter the contents of the status indicator register 195 to select register groups and to enable or to inhibit interrupt. LOW, EQ, and CARRY condition indicators in ALU 181 are not altered. The immediate data (byte two) is divided into five parts. BITS 0–3 are the new register group bits (new register group is coded in binary). BIT 5 is the command bit to put BITS 0–3 into the internal register group buffer if the command bit is a zero. BIT 7 is the new interrupt mask (a one masks out interrupts). BIT 6 is the command bit to put BIT 7 into the internal interrupt mask if the command bit is a zero.

The accumulator arithmetic instructions A1 and S1, respectively add or subtract an absolute one to or from the contents of the accumulator 183, 185, and the result is left in the accumulator 183, 185. This is sixteen bit signed arithmetic and the ALU 181 condition indicators are set depending on the result.

The accumulator instructions SHL and SHR shift the signal contents of the accumulator 183, 185 left or right one digit position or binary place, respectively. For shift left, the high order bit is shifted into the CARRY latch (not shown) in ALU 181 and a zero is shifted into the low order bit except when the previous instruction was an input CARRY. After an input CARRY, the CARRY latch condition before the shift is shifted into the low order bit. For shift right, the low order bit is shifted into the CARRY latch, and the state of the high order bit is maintained. When SHIFT RIGHT is preceded by input CARRY, the state of the CARRY latch before the shift is shifted into accumulator 183, 185 Bit 15. EQ condition indicator of ALU 81 is set if a 0 is shifted to the carry latch. LOW condition indicator of ALU 181 is set if the resulting contents of the accumulator 183, 185 is all 0's.

The accumulator instruction CLA clears the accumulator 183, 185 to all 0's. Transpose TRA exchanges the low order register 183 with the high order byte register 185 signal contents. The ALU 181 indicators are unchanged.

The accumulator instruction IC transfers the signal state from signal contents of the CARRY latch to the low order bit of the arithmetic-logic unit 181 on the next following instruction if the next instruction is an add, subtract, bump, decrement, shift left, or compare operation. CARRY is set into Bit 15 on a shift right. Interrupt is inhibited by this instruction until the next instruction is performed. The ALU 181 Low indicators is reset and the EQ indicators is set if the carry latch is a 0. If the input carry precedes any instruction other than the ones mentioned above, it will have no effect on instruction execution. If the instruction following the input carry changes the ALU 181 condition indicators, then the indicator information from the input carry is destroyed.

The two Indirect Data Transfer instructions STN and LN can access registers 8–15.

A Power On Reset (POR) initialization places the processor in the following state:

Accumulator = $\phi$
Register Group = $\phi$
Interrupt Mask = 1
LOW, EQ, CARRY = X (unknown)

The microprocessor 170 will begin operation by reading memory location 65,533.

MICROPROCESSOR INSTRUCTION EXECUTION

The processor 170 is pipelined to allow the memory 172 a full processor cycle for access time. To do this, the microprocessor 170 requests a read from memory several cycles ahead of when it needs a data byte. Several restrictions are maintained throughout the instruction set.

1. Each instruction must fetch the same number of bytes as it uses.
2. Each instruction must leave the microprocessor with the next instruction in the INSTRUCTION BUFFER, IB register 196.
3. At "Phase Two Time" at the beginning of Sequence Two, as later described, the TEMPORARY BUFFER (TB) 197 must contain the byte following the current instruction. (Note that this byte was fetched by the previous instruction.)
4. Each instruction decodes "TERM" (Terminate) as later described, which resets the instruction sequence counter (not shown) in clock 176 for CMP 170 and a separate sequence clock (not shown) for CMP 170 to Sequence One, allows the next fetch to be done from the IB 196 and loads the next instruction into IR 198.
5. At "Phase Two Time" at the beginning of instruction Sequence Two, the low accumulator register 183 and the high accumulator register 185 must contain the appropriate signals. (Note that the previous instruction may have had other data in these registers during its execution.)

Microprocessor 170 is built exclusively of latch logic. $\phi 2$ signals are the output of latches (or static decodes using the output of latches) that are strobed (sampled or transferred by a clock signal called a strobe) at $\phi 2$ time. $\phi 1$ signals are the outputs of latches (or static decodes using the outputs of latches) that are strobed at $\phi 1$ time. $\phi 1$ signals are used as the inputs to $\phi 2$ latches and $\phi 2$ signals are used as the inputs to $\phi 1$ latches.

The fetch decodes (memory references) are done from the IB register 196 at SEQUENCE 1 (SEQ 1) because the IR register 198 is loaded at $\phi 1$, SEQ 1 (FIGS. 7 & 8). At sequences other than SEQ 1, the fetch decode is done from IR register 198. The fetch decodes are $\phi 2$ signals and therefore, are strobed at $\phi 1$. The output of the fetch decodes are strobed into registers ALL 191, ALH 190, OL 200 and SCC 180. The program counter 192 is updated from registers AOL 201 and AOH 202 at a $\phi 2$ time. The execution and designation decodes are $\phi 1$ decodes from IR 198. These decodes are strobed at $\phi 2$ time into SCC 180 to set up the ALU 181 and DESTINATION strobes which occur at $\phi 1$ time. The output signals of ALU 181 are strobed into DB 186, DO 187 or AOH 202 in accordance with the instruction being executed. Then ACL 183 and ACH 185 are updated at $\phi 2$ so another ALU 181 cycle can begin. It takes three processor cycles from the start of a fetch decode to the time that the accumulator 183, 185 is updated. A pipelined configuration means that in some cases a processor can be executing three separate instructions at the same time, as is known in the computer arts.

INSTRUCTION SEQUENCES

An instruction sequence chart in FIGS. 7 and 8 is a convenient shorthand catalog of the internal operation of the processor 170 during each sequence of each instruction. It can be a very useful tool in understanding the processor's operation. This glossary of terms provides the information necessary for proper interpretation of these charts.

GENERAL INFORMATION

The processor 170 is pipelined. While it is executing one instruction, it reads the next two bytes from memory 172. The first byte is valid in IB 196 at the beginning of SEQ 1 and is used during SEQ 1 to provide three SEQ 1 decodes in SCC 180. At $\phi 1$, SEQ 1, IB→IR where it remains until the next $\phi 1$, SEQ 1. All remaining instruction decodes are done from IR 198.

The second byte is in TB 197 at the beginning of SEQ 2. This byte may contain immediate data for the current instruction or it may be a next instruction byte. If it is a next instruction byte, then the current instruction needs to read only one byte from memory to provide the required two bytes. This two byte read occurs for all one byte instructions.

All memory 172 accesses begin at $\phi 1$. The memory data is valid in the data latch register DL 205 via bus IO for CMP 170 by $\phi 2$, i.e., one and a half instruction execution sequences later. In the table below, the memory timing for all instructions are set out together with the register destination (DEST) from data latch register 205.

MEMORY REFERENCE TIMING TABLE

| INSTRUCTION | 1 START | 1 DEST | 2 START | 2 DEST | 3 START | 3 DEST |
|---|---|---|---|---|---|---|
| LR AR SR | 1 | TB | 2 | TB | 3 | TB |
| LRE LRD | 1 | ACL | 2 | ACL | 3 | TB |
| STR | 1 | TB | — | — | — | — |
| AI SI | 1 | TB | 2 | TB | — | — |
| CI GPI LI | | | | | | |
| XI OI NI | 1 | TB | 2 | TB | — | — |
| CB AB SB | | | | | | |
| LB XB OB | | | | | | |
| NB | 1 | TB | 2 | TB | 3 | TB |
| STB | 1 | TB | 3 | TB | — | — |
| A1 S1 SHL | | | | | | |
| SHR | 1 | TB | 2 | TB | | |
| TRA CLA | | | | | | |
| IC TBP TBR | 1 | TB | | | | |
| BAL | 1 | ACL | 2 | X | 5 | TB |
| RTN | 1 | TB | 2 | ACL | 3 | TB |
| | 4 | TB | | | | |
| $\overline{B\phi\phi\ IJO}$ * | 1 | TB | 2 | TB | 3 | TB |
| $B\phi\phi$ IJO | 1 | TB | 2 | TB | | |
| INTERRUPT | 1 | TB | 5 | ACL | 8 | TB |
| | 9 | TB | 10 | TB | | |
| BLI | 1 | TB | 2 | ACL | 3 | TB |
| | 4 | ACL | | | | |
| BSI | 1 | TB | 2 | ACL | 3 | TB |
| IN OUT | 1 | TB | 3 | ACL | 4 | TB |

*A bar over a jump or branch instruction indicates jump or branch was not taken.

| Code | Operation (Phase 2) | Decode |
|---|---|---|
| TB | DL→TB, ACL unchanged | None |
| ACL | DL→ACL, TB unchanged | TACL* or ITAL |
| X | None. ACL and TB are unchanged. Data will be lost unless SDL on line 206 is inhibited by DMA active on line 207. AND circuit 208 blocks $\phi 2$ from generating SDL signals on line 206. DMA means direct memory access as by registers 173, 174. | NOTB* or TBNS |

If IR 198 still contains the current instruction byte, the decodes are static. If the decode is for the overlap cycle of SEQ 1 (with the next instruction byte in IR 198), the ALU 181 condition latches are set during the last sequences (3–5) of the current instruction execution. The designated register is decoded by SCC 180. This special case is shown on the instruction sequence charts, FIGS. 7 and 8, by the terms TBNS or ITAL in the ALU columns.

The operation of the processor 170 in each sequence is divided into two catagories: Control Logic (CL) of SCC 180 and ALU and Destination (ALU). The position of these two blocks within the sequence, (i.e., left half or right half) has no meaning. Operations can occur at $\phi 1$ or $\phi 2$ in either catagory. $\phi 1$ occurs in the middle of a sequence. The $\phi 2$ is always a sequence boundary.

CONTROL LOGIC GLOSSARY

This is a list of terms which appear in the control logic CL columns.

WRITE—WRT

Indicates that a write into memory is initiated at $\phi 1$ rather than a read. A read is the default condition and requires no decodes. The WRT output line (FIG. 5) is active when WRT appears in the chart.

OUTPUT 1ST I/O—OUT 1IO

Indicates that the first cycle I/O code is placed on the output lines IO at $\phi 1$. Address lines AL9 and AL11 of ADC are driven by the decode IOC1. I/O line is active (FIG. 5).

OUTPUT 2ND I/O—OUT 2IO

Indicates that the second cycle I/O code is placed on the output lines IO to $\phi 1$. Address lines AL10 and AL11 of ADS are driven by IOC2. I/O line is active (FIG. 5).

TB→IB

At each $\phi 2$, SEQ 1 of every instruction, the signal contents of TB register 197 are transferred to IB register 196. The signal contents represent the next successive instruction following the current instruction.

IB SET

Same operation as TB→IB but the intent is to stop IB 196 from following TB 197 rather than to save the contents of the TB 197. It is followed at the next $\phi$1 by IB SET TO "TRA".

IB SET TO "TRA"

Indicates that the reset inputs (not shown) on the IB 196 latches (not shown) are driven at $\phi$1. CNT OR PORX drives an overlapping set on bits 0, 3, and 5, producing a "TRA" instruction code, BAL, POR then execute a TRA to complete their respective operations.

(TERM)

Indicates the end of the instruction. SEQ 1 begins at the doubled line 220 on the chart. The sequence counter (not shown S1–S6) in clock 176 is reset by the decode TERM*.

PCI

Indicates a read from memory and a Program Counter Increment. This action is a default condition and no decodes are needed.

$\phi$1: PC+1→AO $\phi$2: AO→PC

PCNI

A "NO OP". Same as PCI except the PC 192 is not updated at $\phi$2. The next PCI reads the same location again as though the first read did not occur. It is used because the processor lines signify something every $\phi$1 and some instructions have no Read/Write or I/O requirements during sequence 1. SPC (Set PC) is inhibited for the jumps and branches, for the shift instructions, and for A1 and S1 instructions.

IBL, IRL, IRH

Indicates a memory access (read or write) to a register. IR (IB) means the register is specified by the low order four bits of IR (IB). IB must be used during SEQ 1. IR 198 is used during all other sequences. L means the access is to the low byte of the register, H specifies the high byte. The decode IRSL* (IR selected) controls the formation of the address at $\phi$1.

| Operation | Control |
|---|---|
| IB(0-3)→AO(0-3) | IBX (SEQ 1 only) |
| IR(0-3)→AO(0-3) | IRX (all other sequences) |
| L=0, H=1→AO(4) | ILH |
| GP(0-2)→AO(5-7) | RGX |
| GP(3)→AO(8) | R3 |
| O→AO(9-14) | TBIR |

TB

Indicates a memory access using the contents of TB 197 as the address. The decode TBSL* (TB selected) controls the formation of the memory address at $\phi$1.

| Operation | Control |
|---|---|
| TB(0-7)→AO(0-7) | TBX |
| GP(3)→AO(8) | R3 |
| O→AO(9-14) | TBIR |

IRL+8

Same as IRL except 1→AO(3). It is used only in the RTN instruction to read the new status from memory. A one is placed on AL(3)

CAL HIGH BITS, TB→AOL

Indicates a memory access to a location being branched to. The decodes TBSL* and AOSL* control address formation at Phase 1. The high bits are calculated by the counter logic CL for PCH+1 and PCH and by the ALU for PCH−1.

| Phase 1: | Operation | Control |
|---|---|---|
| | TB(0-7)→AO(0-7) | TBX |
| | PCH+1→AO(8-14) | AOSL*=1, BNF=1 |
| | PCH→AO(8-14) | AOSL*=1, BNF=0 |
| | PCH−1→AO(8-14) | AOSL*=0 |
| Phase 2: | AO→PC | |

CAL HIGH BITS, IR→AOL

Similar to TB→AOL above except only the low four bits of the IR are used, and bits 4 through 7 are calculated by the counter logic. The decodes IRSL* and AOSL* control address formation by driving other control lines.

| Phase 1: | Operation | Control |
|---|---|---|
| | IR(0-3)→AO(0-3) | IRX |
| | CL(4-7)→AO(4-7) | None (default) |
| | PCH+1→AO(8-14) | AOSL*=1, JF8=1 |
| | PCH→AO(8-14) | AOSL*=1, JF8=0 |
| | PCH−1→AO(8-14) | AOSL*=0 |
| Phase 2 | AO→PC | |

OL, OH, 4L, 4H, 8L, 8H, 12L, 12H

Indicates a memory access to a register directly specified by the control SCC 180. Occurs only during interrupt. L indicates the low byte, H indicates the high byte.

| Phase 1: | Operation | Control |
|---|---|---|
| | Register→AO(0-3) | CN2, CN3 |
| | L=0, H=1→AO(4) | ILH |
| | O→AO(5-13) | TBIR |
| | 1→AO(14) | R9 |

Update PC, ACL→AOH, TB→AOL

Indicates a memory 172 access to an address specified by the contents of TB and ACL. The address is also placed in PC 192 at $\phi$2. The address formation is controlled by AOTB* which drives other control lines. ACL 182 signals go through ALU 181.

| Phase 1: | Operation | Control |
|---|---|---|
| | TB(0-7)→AO(0-7) | TBX |
| | ACL(0-6)→AO(8-14) | SAO |
| Phase 2: | AO→PC | |

ACL→AOH, TB→AOL

Same as above except PC 92 is not updated at Phase 2

Destination (Dest) Glossary

Items with boxes around them (e.g., ACL to DO→ACL) do not always occur. On Branch or Jump taken, the boxed destination occurs only when PCH 192B must be decremented to produce the proper address. The decrement always occurs, but is loaded only when not needed. On all other instructions, the boxed destination occurs if the instruction is also boxed.

Items in parentheses are "don't care" conditions which occur but are not part of the desired operation.

There are 7 standard data transfers:

| | Phase 1 | Phase 2 | Decodes |
|---|---|---|---|
| 1. | ALU→DO | — | None (default) |
| 2. | ALU→DO | DO→ACL | BF3 |
| 3. | ALU→DB | — | DBDS* |
| | ACH→DO | — | |
| 4. | ALU→DB | DB→ACH | BF2 |
| 5. | ALU→AOH | — | AOTB* |
| | TB→AOL | DB→ACH | |
| | ACH→DO | DO→ACL | |
| 6. | PCL→DO | — | PCSL·PSX |
| 7. | STATUS→DO | — | STSL·PSX |

Any variations of these are decoded separately as exceptions.

MISCELLANEOUS OPERATIONS

Update Status

The new status (REG GROUP, EQ, CARRY, LOW, INT MASK) which has been read from memory replaces the old status.

| | Operation | Decode |
|---|---|---|
| (Phase 1) | TB→STATUS | UPST*, CHST, CHST* |
| (Phase 2) | — | |

Clear ACL & ACH

ACL 182 & ACH 185 are reset to zero by driving the reset inputs of the register latches (not shown).

| | | |
|---|---|---|
| (Phase 1) | — | |
| (Phase 2) | 0→ACL, 0→ACH | CLAC |

Processor Forced to Execute TRA

The IB 196 has been reset to a TRA instruction. The sequence counter (not shown) in clock 176 is reset to SEQ 1 and the processor executes the TRA before the next instruction from memory.

Interrupt is prevented from occurring until after the TRA is completed.

AC7*→EQ

The EQ indicator is set by AC7* (used by I/O instruction), the bit 7 of ACL 183.

IC SETS IC

The Input Carry instruction sets the IC latch (not shown) in ALU 181.

"32"→DO

1→DO(5). Part of POR code.

ALU GLOSSARY

This is a list of terms which appear in the ALU category.

X

ALU NO-OP. No ALU decodes are provided. ALU 181 output at 182 defaults to all 1's.

ACL±TB

ALU 181 output is either ACL plus TB 197 or ACL 183 minus TB 197 depending on whether instruction was an ADD or a SUBTRACT.

ACL×TB

ALU output is some logical combination of ACL and TB which is dependent on the actual instruction.

ACL

ALU output is ACL

TB

ALU output is TB (MODIF) ALU output is modified in some manner depending on the instruction. Example: On an IN or OUT instruction, TB→DO except for bits 5 and 6 which are modified to reflect 0 and OUT respectively. ALU output is shown as TB (MODIF). ACL INCR/DECR ALU output is ACL plus 1 or ACL minus 1 depending on the instruction. PCH1 ALU output is PCH minus 1. PCH1+CR is the same as PCH1 except carry is added TBNS, ITAL ALU NOOP. The destination of data signals entering the processor at the end of Sequence 1 via register 105 must be specified by the previous instruction (although that instruction is no longer in the machine). To accomplish this action, two sets of latches are necessary. The ALU latches are used as the first set. The ALU latches drive the second set, TBNS and ITAL.

ITAL specifies the ACL as the destination. TBNS specifies no destination. The default condition (no decodes) specifies the TB as the destination.

Memory Addressing

Figures 9, 10:
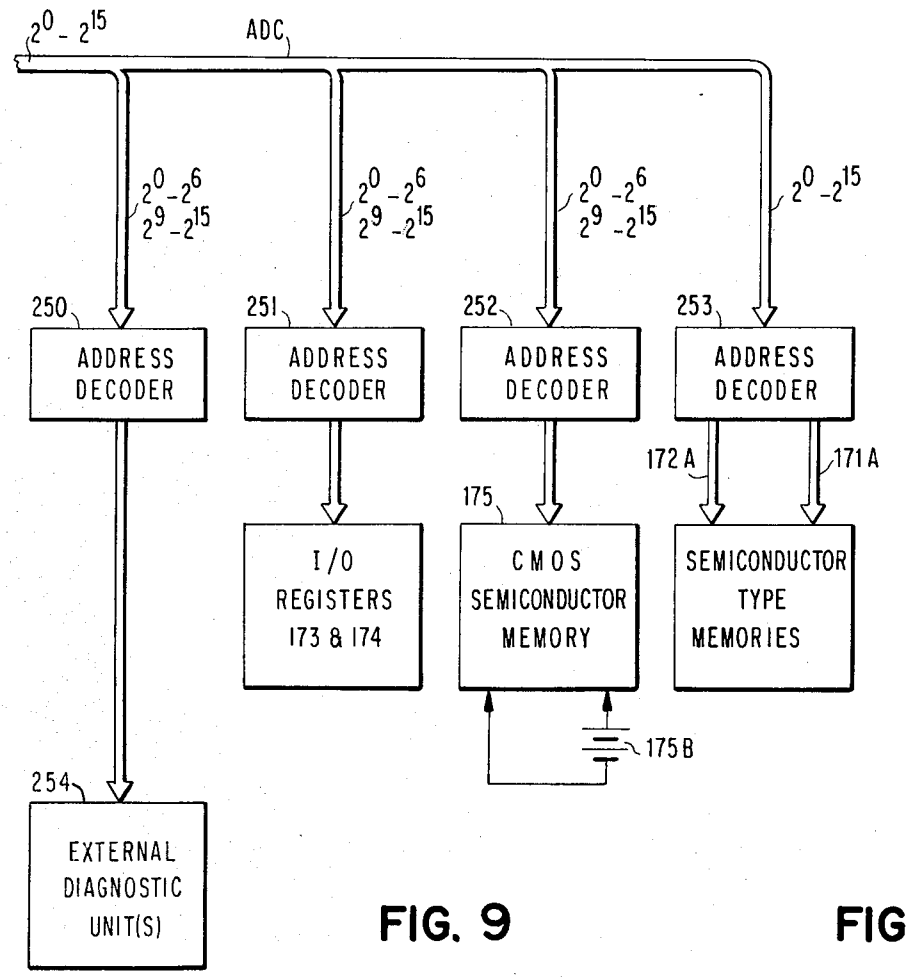
FIG. 9 is a block diagram of a memory addressing scheme for the FIG. 4 illustrated system.
FIG. 10 is an address space diagram for the memory addressed by the FIG. 9 illustrated circuits.

The memory addressing of CMP 170 is shown in FIGS. 9 and 10. The address bus ADC goes to a plurality of address decoders 250–253. Decoder 250 decodes the indicated address bits for selecting external diagnostic unit addresses. Such external diagnostic unit addresses are shown in FIG. 10 as being respectively in groups 7, 15, 23 and 31 of the lower 1000 byte address base of the processor address. Each of the groups include 32 byte addresses. For example, group 0 in zone 0 includes addresses 0–31, and so forth. The address decoder 250 addresses external diagnostic units 254 which are connected to copy production machine 10 via plugs (not shown). Diagnostic units 254 are capable of exercising the copy production machine 10 via processor control in a manner beyond the scope of the present description. Decoder 251 addresses the I/O registers which include input registers 173 and output registers 174. It will be remembered that input registers 173 are input only such that CMP 170 can only read the signal contents of such registers; it cannot record in such registers. In a similar manner, output registers 174 can only receive signals from CMP 170 for supplying control signals to CPP 13 and other units of copy production machine 10. It should be noted that the address space for the input/output registers is repeated, i.e., the same address bits will access any of the input/output registers in all four zones of the memory space. Accordingly, not all address bits are supplied to address decoder 251 in the same manner that bits were eliminated from address decoder 250 for enabling repeated diagnostic address space. This is achieved because the characteristics of the address selection circuits of CMP 170 are faster if all of the addressing for program execution is maintained within the indicated FIG. 10 address zones. Switching zones delay processor action. Reasons for this delay is beyond the scope of the present description.

Address decoder 252 also has the same bits eliminated from its address field for addressing the nonvolatile memory 175. CMOS address space is in groups 4 and 5 of zone 0; 12 and 13 of zone 1; 20 and 21 of zone 2; and 28, 29 of zone 3.

Address decoder 253 addresses ROS control store 171 via address lines 171A and working store memory 172 via address lines 172A to semiconductive type memories. All of the address bits from ADC are applied to decoder 253.

In FIG. 10, the remaining groups of registers (address space) in the lower 1000 byte address field of CMP 170 are also a part of working store 172 to be addressed via address lines 172A. All address bits are used to access these work registers for uniquely maintaining the signals therein with respect to various programs in CMP 170.

CMP 170 operates within the above-described addressing structures in the following manner. A memory address zone is selected with the work registers in their respective address groups being used for storing intermediate results. References to input/output, diagnostics and nonvolatile memory 175 are the same for all of the zones, thereby improving efficiency of CMP 170 in avoiding zone switching for accessing such universally used portions of the address space.

While the invention has been particularly shown and described with reference to preferred embodiments thereof, it will be understood by those skilled in the art that various changes in form and details may be made therein without departing from the spirit and scope of the invention.

```
LOC   OBJ     OP1   OP2        SOURCE STATEMENT
5D1A  A662    0062                 LB      CEMODE
5D1C  A808    0008                 CI      CESADF
5D1E  62      5D22                 JNE     SADF23A
5D1F  308F5E  5E8F  0000           BU      SADF03, R0
                                 1. THEN
      5D22          SADF23A  DC    *
                               2. . IF ¬INHFD1 (  MANUAL OPERATION)
                                    TPB     PSB31,INHFD1
5D22  A65F    005F
5D24  95      0005
5D25  49      5D29                 JZ      SADF23B
5D26  308F5E  5E8F  0000           BU      SADF03,R0
                               2. . THEN
      5D29          SADF23B  DC    *
                               3. . . IF ¬LFTCRDOC &LIDDWNSW
                                    TPB     PCB05,LFTCRDOC
5D29  A676    0076
5D2B  97      0007
5D2C  348F    5E8F                 BNZ     SADF03
                                   RIN     CSB09
5D2E  A6D0    00D0
5D30  95      0005                 TP      LIDDWN
5D31  358F    5E8F                 BZ      SADF03
                               3. . . THEN
                               4. . . . PROCESS SADFENTR TO ENTER A DOCUMENT ONTO GLASS
                                      INCLUDE SADFENTR
```

APPENDIX TABLE B — SADF ENTRY

```
LOC   OBJ     OP1   OP2        SOURCE STATEMENT
                                     ISEG SADFENTR
                                   BEGIN SADFENTR
      5D33          SADFENTR  DC
                                 1. TEXT
                               THIS SEGMENT MONITORS PRE-ENTRY,STARTS ENTRY,SETS SADFBUSY
                                 1. ENDTEXT
                                 1. IF ORGATDF
                                      RIN          CSB09
5D33  A6D0    00D0
5D35  94      0004                   TP           ORGATDF
5D36  3DC6    5DC6                   BZ           SADF30
                                 1. THEN
                                 2. . SET CLUTCH TIMER=255
5D38  AEFF    00FF                   LI           255
5D3A  A15B    005B                   STB          CLUTCHTR
                                 2. . IF RELAY2=0
5D3C  A9A0    00A0                   GI           INTOFF
5D3E  A67C    007C                   LB           PCB12
```

-continued

APPENDIX TABLE B — SADF ENTRY

| LOC | OBJ | OP1 | OP2 | SOURCE STATEMENT | | |
|---|---|---|---|---|---|---|
| 5D40 | AF40 | 0006 | | | TS | RELAY2 |
| 5D42 | 69 | 5D49 | | | JNZ | ENTER1 |
| | | | | 2. . THEN | | |
| | | | | 3. . . TURN RELAY 2 ON | | |
| 5DBF | 64 | 5DC4 | | | UNZ | SADF29 |
| | | | | 4. . . . THEN | | |
| | | | | 5. . . . SET ALIGNTMR=3 | | |
| 5DC0 | AE03 | 0003 | | | LI | 3 |
| 5DC2 | A14B | 004B | | | STB | ALIGNTMR |
| | | | | 4. . . . ENDIF | | |
| | | | | 3. . . ENDIF | | |
| | | | | 2. . ENDIF | | |
| | | 5DC4 | SADF29 | | DC | * |
| 5DC4 | 2CF6 | 5DF6 | | | B | SADF31 |
| | | | | 1. ELSE | | |
| | | 5DC6 | SADF30 | | DC | * |
| | | | | 2. . IF ¬DFENTRY | | |
| 5DC6 | A679 | 0079 | | | LB | PCB09 |
| 5DC8 | 95 | 0005 | | | TP | DFENTRY |
| 5DC9 | 3CE0 | 5DE0 | | | BNZ | SADF30A |
| | | | | 2. . THEN | | |
| | | | | 3. . . IF DFCLUTCH=0 (ALIGNER ON) | | |
| 5DCB | A9A0 | 00A0 | | | GI | INTOFF |
| 5DCD | A679 | 0079 | | | LB | PCB09 |
| 5DCF | AF04 | 0002 | | | TS | DFCLUTCH |
| 5DD1 | 3CF6 | 5DF6 | | | BNZ | SADF31 |
| | | | | 2. . ELSE | | |
| | | | | 3. . . IF ORGINDF &ALIGNTMR ¬=0 | | |
| | | | | | RIN | CSB09 |
| 5DE0 | A6D0 | 00D0 | | | | |
| 5DE2 | 93 | 0003 | | | TP | ORGINDF |
| 5DE3 | 3DF6 | 5DF6 | | | BZ | SADF31 |
| 5DE5 | A64B | 004B | | | LB | ALIGNTMR |
| 5DE7 | A800 | 0000 | | | CI | 0 |
| 5DE9 | 46 | 5DF6 | | | JE | SADF31 |
| | | | | 3. . . THEN | | |
| | | | | 4. . . . DECREMENT ALIGNTMR | | |
| 5DEA | 2A | | | | S1 | |
| 5DEB | A14B | 004B | | | STB | ALIGNTMR |
| | | | | 4. . . . IF ALIGNTMR=0 | | |
| 5DED | A800 | 0000 | | | CI | 0 |
| 5DEF | 66 | 5DF6 | | | JNE | SADF31 |
| | | | | 4. . . . THEN | | |
| | | | | 5. . . . . SET ENTERING | | |
| | | | | | TSB | PSB31,ENTERING |
| 5DF0 | A65F | 005F | | | | |
| 5DF2 | AF01 | 0000 | | | | |
| 5DF4 | A15F | 005F | | | | |
| | | | | 4. . . . ENDIF | | |
| | | | | 3. . . ENDIF | | |
| | | | | 2. . ENDIF | | |
| | | | | 1. ENDIF | | |
| | | 5DF6 | SADF31 | | DC | * |
| 5DF6 | A920 | 0020 | | | GI | INTON |
| | | | | ENDBEGIN SADFENTR | | |
| | | | | | IEND SADFENTR | |

APPENDIX TABLE C - SADF CONTROL

| LOC | OBJ | OP1 | OP2 | SOURCE STATEMENT | | |
|---|---|---|---|---|---|---|
| | | | | 4. . . . IF SADFBUSY | | |
| | | | | | TPB | PSB31,SADFBBUSY |
| 5E1A | A65F | 005F | | | | |
| 5E1C | 93 | 0003 | | | | |
| 5E1D | 3D8F | 5E8F | | | BZ | SADF03 |
| | | | | 4. . . . THEN | | |
| | | | | 5. . . . IF ORGINDF &DFBELT = 1 & DFEXIT | | |
| | | | | | RIN | CSB09 |
| 5E1F | A6D0 | 00D0 | | | | |
| 5E21 | 93 | 0003 | | | TP | ORGINDF |
| 5E22 | 3C8B | 5E8B | | | BNZ | SADF02 |
| 5E24 | A679 | 0079 | | | LB | PCB09 |
| 5E26 | 96 | 0006 | | | TP | DFBELT |
| 5E27 | 3D8B | 5E8B | | | BZ | SADF02 |
| 5E29 | 94 | 0004 | | | TP | DFEXIT |
| 5E2A | 3C8B | 5E8B | | | BNZ | SADF02 |
| | | | | 5. . . . . THEN | | |

-continued

APPENDIX TABLE C - SADF CONTROL

```
LOC   OBJ   OP1   OP2        SOURCE STATEMENT
                             6. . . . . DECREMENT TET
5E2C  A64C  004C                LB        TET
5E2E  2A                        SI
5E2F  A14C  004C                STB       TET
                             6. . . . . IF TET < = 0
5E31  A800  0000                CI        0
5E33  3E8F  5E8F                BH        SADF03
                             6. . . . . THEN
                             7. . . . . . IF ENTERING=1
                                TPB       PSB31,ENTERING
5E35  A65F  005F
5E37  90    0000
5E38  3D87  5E87                BZ        SADF01A
                             7. . . . . . THEN
                             8. . . . . . . DFENTRY = 0
5E3A  A9A0  00A0                GI        INTOFF
                                TRB       PCB09,DFENTRY
5E3C  A679  0079
5E3E  B5    0005
5E3F  A179  0079
5E41  A920  0020                GI        INTON
                             8. . . . . . . IF SADFTMR ≦ KI &  INDF &  SADFEXIT
                                LID       350
5E43  AE01  015E
5E45  29
5E46  AE5E  015E
5E48  CA    000A                SR        SADFTMR
                                BL        SADF01
5E49  3F4D  5E4D
5E4B  2C62  5E62
5E4D  A65F  005F                LB        PSB31
                                TSM       P(INDF,SADFEXIT)
5E4F  AF42  0042
5E51  62    5E62                JNZ       SADF01
                             8. . . . . . . THEN
                             9. . . . . . . . STARTDF = 1
5E52  A9A0  00A0                GI        INTOFF
                                TSB       PSB22,STARTDF
5E54  A656  0056
5E56  AF08  0003
5E58  A156  0056
                             9. . . . . . . . INDF = 1
                                TSB       PSB31,INDF
5E5A  A65F  005F
5E5C  AF40  0006
5E5E  A15F  005F
5E60  A920  0020                GI        INTON
                             8. . . . . . . ENDIF
            5E62        SADF01 DC
                             8. . . . . . . IF SADFTMR ≦ K2
                                LID       320
5E62  AE01  0140
5E64  29
5E65  AE40  0140
5E67  CA    000A                SR        SADFTMR
                                BL        SADF04
5E68  3F6C  5E6C
5E6A  2C9B  5E9B
                             8. . . . . . . THEN
                             9. . . . . . . . DFBELT = 0
                             9. . . . . . . . SADFTMR = 0
5E6C  A9A0  00A0                GI        INTOFF
                                TRB       PCB09,DFBELT
5E6E  A679  0079
5E70  B6    0006
5E71  A179  0079
5E73  A920  0020                GI        INTON
5E75  25                        CLA
5E76  8A    000A                STR       SADFTMR
                             9. . . . . . . . IF  ORGATDF
                                RIN       CSB09
5E77  A6D0  00D0
5E79  94    0004                TP        ORGATDF
5E7A  3C8F  5E8F                BNZ       SADF03
                             9. . . . . . . . THEN
                             10. . . . . . . . . DFCLUTCH = 1
5E7C  A9A0  00A0                GI        INTOFF
                                TSB       PCB09,DFCLUTCH
5E7E  A679  0079
5E80  AF04  0002
```

-continued

APPENDIX TABLE C - SADF CONTROL

| LOC | OBJ | OP1 | OP2 | SOURCE STATEMENT | | |
|---|---|---|---|---|---|---|
| 5E82 | A179 | 0079 | | | | |
| 5E84 | A920 | 0020 | | | GI | INTON |
| 5E86 | OF | 5E8F | | | J | SADF03 |
| | | | | 9. . . . . ENDIF | | |
| | | | | 8. . . . . ENDIF | | |
| | | 5E87 | | SADF01A DC * | | |
| | | | | 7. . . . . ELSE | | |
| | | | | 8. . . . . SADFTMR = 1 | | |
| 5E87 | 25 | | | | CLA | |
| 5E88 | AE01 | 0001 | | | LI | 1 |
| 5E8A | 8A | 000A | | | STR | SADFTMR |
| | | | | 7. . . . . ENDIF | | |
| | | | | 6. . . . . ENDIF | | |
| | | | | 5. . . . . ELSE | | |
| | | 5E8B | | SADF02 DC | | |
| | | | | 6. . . . . TET = 12 | | |
| 5E8B | AE0C | 000C | | | LI | 12 |
| 5E8D | A14C | 004C | | | STB | TET |
| | | | | 5. . . . . ENDIF | | |
| | | | | 4. . . . ENDIF | | |
| | | | | 3. . . ENDIF | | |
| | | | | 2. . ENDIF | | |
| | | | | 1. ENDIF | | |
| | | 5E8F | | SADF03 DC | | |
| | | | | 1. IF SADFEXIT = 1 | | |
| 5E9F | A65F | 005F | | | LB | PSB31 |
| | | | | 5. . . . . ENDIF | | |
| | | | | 4. . . . ENDIF | | |
| | | | | 3. . . ENDIF | | |
| | | | | 2. . ENDIF | | |
| | | | | 1. ENDIF | | |
| | | 5E8F | | SADF03 DC | | |
| | | | | 1. IF SADFEXIT = 1 | | |
| 5E8F | A65F | 005F | | | LB | PSB31 |

What is claimed is:

1. The combination comprising:

transport means for moving an object along a given path;

a plurality of sensing means disposed at different positions in the vicinity of said given path for producing signals indicative of the position of said object; and sequence detection means responsive to said plurality of sensing means for producing indications of the direction of movement of said objects along the given path.

2. The invention as claimed in claim 1 including control means responsive to said sequence detection means for producing a start signal when the direction of movement is in one direction and an inhibit signal when said direction of movement is in a different direction; and utilization means for operating in response to said start signal and not operating in response to said inhibit signal.

3. In a copy production machine having a copy production portion, an output portion, and an image input portion including a document feed means responsive to a document to be entered for moving the document into an imaging position, the improvement comprising, in combination:

first sensor means for producing a first signal indicating that said document is in an initial position;

second sensor means for producing a second signal indicating that said document is in a second position from which it is to be entered into said imaging position; and control means for controlling the starting of said copy production portion having means responsive to said sensors for storing a control signal in response to a conjunction of said first and second signals, said control means also having means for producing a start enable signal in response to a concurrence of a conjunction of said control signal and said second signal with a subsequent absence of said first signal.

4. In a copy production machine having a copy production portion, an output portion, and an image input portion including a document feed means responsive to an original document to be entered for moving the document into an imaging position, the improvement comprising, in combination:

sensing means for producing signals indicating that said original document is to be entered to said imaging position;

means for storing said signals indicating that said document is to be entered;

means comparing said stored signals and signals from said sensing means for producing an indication that a document is being removed; and control means responsive to said indication that a document is being removed for inhibiting starting a copy production run in said copy production machine.

5. The copy production machine set forth in claim 4 wherein said sensing means includes a plurality of sensing elements for indicating direction of movement of said original document, and wherein said means for producing an indication are responsive to said direction of movement to determine whether a document is being entered or removed from said document feed means.

6. The invention claimed in claim 5 wherein said sensing means includes means for producing a plurality of signals in one predetermined sequence when said original document is being entered and in a different sequential order when said original document is being removed.

7. The invention claimed in claim 6 wherein said control means includes start inhibiting means responsive to said different sequential order of said plurality of signals.

8. The method of operating a copy production machine having a copy production portion, an output portion, and an image input portion including a document feed responsive to an original document to be entered for moving the document into an imaging position, comprising the steps of:

sensing that said original document is to be entered;

sensing that said original document is about to be entered;

sensing that the original document about to be entered is being removed; and inhibiting starting a copy production run in said copy production machine if said document is being removed.

9. The invention as claimed in claim 8 wherein said third sensing step includes the steps of sensing sequential positions of said original document.

* * * * *